US008172383B2

(12) United States Patent
Kanbe et al.

(10) Patent No.: US 8,172,383 B2
(45) Date of Patent: May 8, 2012

(54) INK CARTRIDGE ASSEMBLIES HAVING ADAPTER FOR EASILY REMOVING INK CARTRIDGE FROM MOUNTING PORTION

(75) Inventors: Tomohiro Kanbe, Nagoya (JP); Hirotake Nakamura, Nagoya (JP); Shingo Hattori, Nagoya (JP); Akio Yoshinari, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 460 days.

(21) Appl. No.: 12/402,333

(22) Filed: Mar. 11, 2009

(65) Prior Publication Data

US 2009/0322836 A1 Dec. 31, 2009

(30) Foreign Application Priority Data

Jun. 30, 2008 (JP) ..... 2008-171844
Jun. 30, 2008 (JP) ..... 2008-171887

(51) Int. Cl.
*B41J 2/175* (2006.01)

(52) U.S. Cl. ..... 347/86; 347/85

(58) Field of Classification Search ..... 347/86
See application file for complete search history.

(56) References Cited

U.S. PATENT DOCUMENTS 5,138,344 A * 8/1992 Ujita ..... 347/86
5,506,611 A 4/1996 Ujita et al.
5,860,363 A * 1/1999 Childers et al. ..... 347/86
6,062,667 A 5/2000 Matsui et al.
6,076,920 A 6/2000 Zapata et al.
6,312,084 B1 11/2001 Ujita et al.
6,764,169 B2 7/2004 Hall et al.
6,786,583 B2 9/2004 Ota et al.
6,880,313 B1 4/2005 Gessford et al.
7,316,471 B2 1/2008 Hattori et al.
7,360,858 B2 4/2008 Hayamizu et al.
2001/0033315 A1 10/2001 Hatasa et al.
2001/0045977 A1 11/2001 King et al.
2003/0081087 A1 5/2003 Sakai et al.

(Continued)

FOREIGN PATENT DOCUMENTS

CN 2683375 Y 3/2005

(Continued)

OTHER PUBLICATIONS

European Patent Office, European Search Report for Related EP Application No. 08013451 dated Jan. 15, 2009.

(Continued)

*Primary Examiner* — Shelby Fidler
(74) *Attorney, Agent, or Firm* — Baker Botts L.L.P.

(57) ABSTRACT

An ink cartridge includes an ink tank defining an ink chamber therein, in which the ink chamber is configured to store ink therein, and an adapter configured to be coupled to the ink tank. The adapter and the ink tank are separate members, and the adapter includes a main body having a main body opening formed therein. The main body opening is configured to receive at least a portion of the ink tank therein. The ink cartridge also includes at least one resilient member coupled to the adapter. When the adapter is coupled to the ink tank, the ink tank extends from a first face of the main body in a first direction, and the at least one resilient member extends from a second face of the main body in a second direction opposite the first direction.

5 Claims, 18 Drawing Sheets

U.S. PATENT DOCUMENTS

| | | | | |
|---|---|---|---|---|
| 2003/0085967 | A1 | 5/2003 | Ota et al. | |
| 2004/0027432 | A1 | 2/2004 | Childers et al. | |
| 2004/0104984 | A1 | 6/2004 | Hall et al. | |
| 2004/0160496 | A1* | 8/2004 | Tsurui et al. | 347/86 |
| 2004/0176735 | A1 | 9/2004 | Snell | |
| 2005/0168540 | A1 | 8/2005 | Wilson et al. | |
| 2005/0212877 | A1* | 9/2005 | Liang | 347/86 |
| 2005/0275700 | A1 | 12/2005 | Buchanan et al. | |
| 2006/0023040 | A1 | 2/2006 | Castle et al. | |
| 2007/0070141 | A1* | 3/2007 | Hattori et al. | 347/86 |
| 2007/0229615 | A1 | 10/2007 | Hattori et al. | |
| 2007/0279464 | A1* | 12/2007 | Harazim | 347/86 |
| 2008/0198210 | A1* | 8/2008 | Umeda | 347/86 |
| 2008/0239038 | A1* | 10/2008 | Yoshimoto et al. | 347/86 |
| 2009/0207215 | A1 | 8/2009 | Fost | |
| 2010/0103231 | A1* | 4/2010 | Iwamura et al. | 347/86 |
| 2010/0289847 | A1* | 11/2010 | Ishizawa et al. | 347/86 |

FOREIGN PATENT DOCUMENTS

| | | | |
|---|---|---|---|
| CN | 101195302 | A | 6/2008 |
| EP | 1839871 | A | 10/2007 |
| EP | 1839873 | A | 10/2007 |
| EP | 1905596 | A1 * | 4/2008 |
| EP | 2045079 | A1 | 4/2009 |
| JP | H03-213349 | A | 9/1991 |
| JP | 2005-028614 | A | 2/2005 |
| JP | 2007-144811 | A | 6/2007 |
| WO | 9745269 | A | 12/1997 |
| WO | 0119615 | A | 3/2001 |

OTHER PUBLICATIONS

The State Intellectual Property Office of the People's Republic of China, Notification of the Second Office Action for Chinese Patent Application No. 200810211194.4 (counterpart to above-captioned patent application), issued Apr. 20, 2011.

The State Intellectual Property Office of the People's Republic of China, Notification of First Office Action for Chinese Patent Application No. 200810211192.5 (counterpart to above-captioned patent application), issued Sep. 13, 2010.

European Patent Office, European Search Report for European Patent Application No. 08013450.5 (counterpart to above-captioned patent application), dated Jan. 12, 2009.

European Patent Office, Office Action for European Patent Application No. 08013451.3 (counterpart to above-captioned patent application), dated May 19, 2011.

European Patent Office, Observations by Third Party concerning European Patent Application No. 08013451.3 (counterpart to above-captioned patent application), dated Apr. 12, 2011.

European Patent Office, extended European Search Report for European Patent Application No. 11160606.7 (counterpart to above-captioned patent application), dated May 23, 2011.

European Patent Office, extended European Search Report for European Patent Application No. 11160584.6 (counterpart to above-captioned patent application), dated May 23, 2011.

* cited by examiner

INK CARTRIDGE ASSEMBLIES HAVING ADAPTER FOR EASILY REMOVING INK CARTRIDGE FROM MOUNTING PORTION

CROSS-REFERENCE TO RELATED APPLICATION

The present application claims priority from Japanese Patent Application No. JP-2008-171887, which was filed on Jun. 30, 2008, and Japanese Patent Application No. JP-2008-171844, which was filed on Jun. 30, 2008, the disclosures of which are incorporated herein by reference in their entirety.

BACKGROUND OF THE INVENTION

1. Field of the Invention

The present invention relates generally to ink cartridges. In particular, the present invention is related to ink cartridges which are configured to be removably mounted to a cartridge mounting portion of a recording apparatus.

2. Description of Related Art

A known inkjet recording apparatus is configured to record an image on a sheet of paper with ink. This known inkjet recording apparatus has a recording head, and the recording head has a plurality of nozzles formed therein. The recording head is configured to selectively eject ink from the nozzles such that an image is formed on a sheet of paper. The inkjet recording apparatus has a cartridge mounting portion to which a known ink cartridge is removably mounted. The ink cartridge has an ink chamber configured to store ink therein, and when the ink cartridge is mounted to the mounting portion, ink is allowed to be supplied from the ink chamber to the recording head.

Another known recording apparatus comprises a mounting portion and a lever pivotably provided at the mounting portion. Another known ink cartridge is configured to be mounted to the mounting portion. The lever has claws, and the ink cartridge has engage portions. After the ink cartridge is mounted to the mounting portion, when the lever pivots, the claws engage and pull the engage portions, such that the ink cartridge is pulled toward an exterior of the mounting portion. Consequently, the ink cartridge is partially positioned outside the mounting portion, and a user grasps the portion of the ink cartridge, which portion is positioned outside the mounting portion, and remove the ink cartridge from the mounting portion. Such a known inkjet recording apparatus and a known ink cartridge are described in JP-A-2007-144811.

Nevertheless, the claws and the engage portions need to be accurately positioned to engage each other. If the claws and the engage portions fail to be accurately positioned, the claws may not engage portions when the lever pivots. In such a case, the ink cartridge may not be pulled to the exterior of the mounting portion. Moreover, if the claws are accidentally broken, the ink cartridge also may not be pulled to the exterior of the mounting portion. In addition, the portion of the ink cartridge which is pulled out of the mounting portion by the claws may be a small portion, and it may be difficult for a user with a big hand to grasp the small portion of the ink cartridge to remove the ink cartridge from the mounting portion.

SUMMARY OF THE INVENTION

Therefore, a need has arisen for an adapter of an ink cartridge, which overcomes these and other shortcomings of the related art. A technical advantage of the present invention is that an ink cartridge is readily removed from a mounting portion with an aid of an adapter.

According to an embodiment of the present invention, an ink cartridge comprises an ink tank defining an ink chamber therein, in which the ink chamber is configured to store ink therein, and an adapter configured to be coupled to the ink tank. The adapter and the ink tank are separate members, and the adapter comprises a main body having a main body opening formed therein. The main body opening is configured to receive at least a portion of the ink tank therein. The ink cartridge also comprises at least one resilient member coupled to the adapter. When the adapter is coupled to the ink tank, the ink tank extends from a first face of the main body in a first direction, and the at least one resilient member extends from a second face of the main body in a second direction opposite the first direction.

Other objects, features, and advantages of embodiments of the present invention will be apparent to persons of ordinary skill in the art from the following description of preferred embodiments with reference to the accompanying drawings.

BRIEF DESCRIPTION OF DRAWINGS

For a more complete understanding of the present invention, the needs satisfied thereby, and the objects, features, and advantages thereof, reference now is made to the following description taken in connection with the accompanying drawings.

DETAILED DESCRIPTION OF EMBODIMENTS

Embodiments of the present invention and their features and technical advantages may be understood by referring to FIGS. 1-18, like numerals being used for like corresponding portions in the various drawings.

Figure 1:
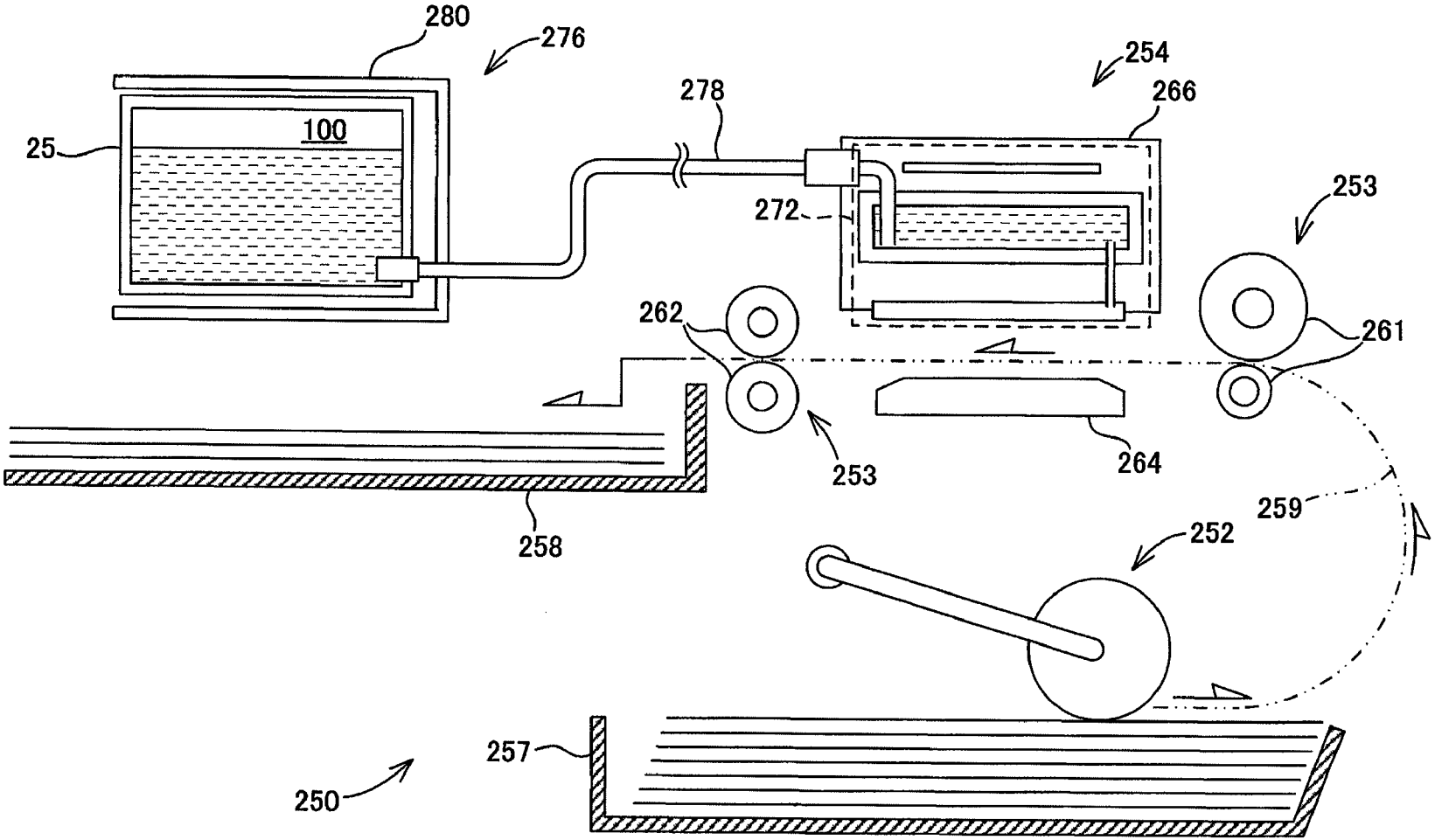
FIG. 1 is a cross-sectional, pattern diagram of a recording apparatus according to an embodiment of the invention.

Referring to FIG. 1, an inkjet recording apparatus 250 according to an embodiment of the invention is depicted. Recording apparatus 250 is configured to record an image, e.g., a monochrome image or color image, on a recording medium, e.g., a sheet of paper, with at least one ink, e.g., four inks such as a black ink, a yellow ink, a cyan ink, and a magenta ink. Recording apparatus 250 comprises a feeding device 252, transferring device 253, a recording device 254, and a cartridge mounting portion 276. Cartridge mounting portion 276 is configured to receive an ink cartridge 25. Recording apparatus 250 also comprises a first tray 257 and a second tray 258, and recording apparatus 250 has a transfer path 259 extending from first tray 257 to second tray 258. Feeding device 252 is configured to feed sheets of paper accommodated in first tray 257 one by one to transfer path 259.

Transferring device 253 comprises a first pair of transfer rollers 261 and a second pair of transfer rollers 262 positioned along transfer path 259. First pair of transfer rollers 261 is positioned on the upstream side of recording device 254 and second pair of transfer rollers 262 is positioned on the downstream side of recording device 254 along transfer path 259.

Recording apparatus 250 also comprises a platen 264 positioned directly below recording device 254. The sheet of paper fed by feeding device 252 is transferred onto platen 264 by first pair of transfer rollers 261. Recording device 254 is configured to record an image on the sheet of paper being transferred over platen 264. The sheet of paper having passed over platen 264 is transferred by second pair of transfer rollers 262 to second tray 258, which is positioned at the downstream end of transfer path 259.

Recording device 254 comprises a carriage 266, and a recording head 272 mounted in carriage 266. Carriage 266 is supported by rails (not shown) such that carriage 266 slides on rails in a direction perpendicular to the paper plane of FIG. 1. Recording head 272 is configured to eject ink onto the sheet of paper.

Cartridge mounting portion 276 is configured to mount at least one ink cartridge 25, e.g., four ink cartridges 25 storing four kinds of inks such as a black ink, a yellow ink, a cyan ink, and a magenta ink, respectively. Cartridge mounting portion 276 also is configured to mount at least one adapter 27, e.g., four adapters 27 corresponding to four ink cartridges 25, respectively. Cartridge mounting portion 276 comprises at least one case 280, e.g., four cases 280 corresponding to four ink cartridges 25 and four adapters 27, respectively. Ink cartridge 25 and adapter 27 are configured to be inserted into and removed from case 280. Ink cartridge 25 comprises an ink chamber 100 defined therein, and ink chamber 100 is configured to store ink therein. Recording apparatus 250 comprises at least one flexible tube 278, e.g., four, flexible tubes 278 connected to cases 280, respectively, and to recording head 272. When ink cartridge 25 and adapter 27 are mounted to cartridge mounting portion 276, ink is allowed to be supplied from ink chamber 100 to recording head 272 via a corresponding one of tubes 278.

Referring to FIGS. 2(A) to 3(B), ink cartridge 25 according to an embodiment of the invention has a substantially rectangular parallelepiped shape. A width of ink cartridge 25 in a width direction as indicated by an arrow 31 is relatively short, and each of a height of ink cartridge 25 in a height direction as indicated by an arrow 32 and a depth of ink cartridge 25 in a depth direction as indicated by an arrow 33, is greater than the width of ink cartridge 25. Ink cartridge 25 comprises a top outer face 43 and a bottom outer face 44 opposite top outer face 43, and when ink cartridge 25 is mounted to cartridge mounting portion 276, top outer face 43 is positioned above bottom outer face 44. Ink cartridge 25 is configured to be inserted into case 280 in an insertion direction 30, which is parallel to depth direction 33. Ink cartridge 25 comprises a front outer face 41, a rear outer face 42 opposite front outer face 41, a left side outer face 45, and a right side outer face 46 opposite left side outer face 45. Each of front outer face 41 and rear outer face 42 is connected to top outer face 43 and bottom outer face 44, and each of left side outer face 45 and right side outer face 46 is connected to front outer face 41, rear outer face 42, top outer face 43, and bottom outer face 44. Front outer face 41, rear outer face 42, top outer face 43, bottom outer face 44, left side outer face 45, and right side outer face 46 are substantially parallel to its opposing face, and substantially perpendicular to the other faces. Each of an area of left side outer face 45 and an area of right side outer face 46 is greater than each of an area of front outer face 41, an area of rear outer face 42, an area of top outer face 43, and an area of bottom outer face 44. Ink cartridge 25 is inserted into case 280 from front outer face 41-side.

Ink cartridge 25 comprises a frame 50, a movable member, e.g., a pivotable member 70, an air communication portion 80, an ink supply portion 90, a pair of side walls 60, a detection portion 140, and a protrusion 145. Frame 50 defines front outer face 41, rear outer face 42, top outer face 43, and bottom outer face 44 of ink cartridge 25. Pair of side walls 60 is connected to, e.g., attached to, frame 50, respectively, and pair of side walls 60 defines left side outer face 45 and right side outer face 46 of ink cartridge 25, respectively.

Frame 50 is formed of a translucent resin material, e.g., a transparent material or a semi-transparent material, and light, e.g., visible or infrared light, passes therethrough. In this embodiment, frame 50 is manufactured by injection-molding polypropylene. Alternatively, frame 50 may be manufactured by injection-molding polyacetal, nylon, polyethylene, or the like. Frame 50 integrally comprises detection portion 140 positioned at front outer face 41. Detection portion 140 is formed of the same material as frame 50. Alternatively, substantially an entirety of frame 50 is formed of an opaque resin material, but detection portion 140 is formed of a translucent resin material, e.g., a transparent material or a semi-transparent material, and light, e.g., visible or infrared light, passes therethrough.

Frame 50 has a substantially square or rectangular perimeter extending along front outer face 41, top outer face 43, rear outer face 42, and bottom outer surface 44 defining a space in the interior thereof. Openings surrounded by frame 50 are formed on both ends of frame 50 in width direction 31, respectively. Pair of side walls 60 is connected to, e.g., adhered to, the ends of frame 50 in width direction 31, respectively, via an adhesion method, e.g., a thermal adhesion method, such that the openings are covered by pair of side walls 60, respectively, and a space surrounded by frame 50 and pair of side walls 60 defines ink chamber 100 therein. Pair of side walls 60 is formed of the same material as the frame. Pair of side walls 60 may be a pair of translucent flexible films, e.g., transparent or semi-transparent flexible films. Ink cartridge 25 may comprise a pair of covers covering pair of side walls 60 from the exterior of pair of side walls 60 to reinforce the rigidity of ink cartridge 25.

An amount of ink stored in ink chamber 100 is optically or visually detected via detection portion 140. Detection portion 140 extends outward from a middle portion of front outer face 41 of frame 50 in height direction 32. Detection portion 140 extends away from ink chamber 100. Detection portion 140 comprises five rectangular walls and have a substantially a hollow box shape. For example, detection portion 140 comprises a front wall 140A, a pair of side walls 140B, a top wall 140C, and a bottom wall 140D. Front wall 140A extends parallel to front outer face 41 and is separated from front outer face 41 by a predetermined distance. Side walls 140B are connected to front outer face 41 and front wall 140A, top wall 140C is connected to top ends of front wall 140A and side walls 140B, and bottom wall 140D is connected to bottom ends of front wall 140A and side walls 140B. Moreover, the width of front wall 140A is less than the width of front face 41 in width direction 31. Detection portion 140 is configured to receive light, e.g., visible or infrared light, emitted from an optical sensor 230, e.g., a photo interrupter, positioned in cartridge mounting portion 276. When ink cartridge 25 is mounted to cartridge mounting portion 276, a light emitting portion of optical sensor 230 faces one of side walls 140B and a light receiving portion of optical sensor 230 faces the other of the side walls 140B. Light emitted from the light emitting portion of optical sensor 230 may pass through side walls 140B and reach the light receiving portion of optical sensor 230.

Detection portion 140 has an inner space 142 defined by front wall 140A, side walls 140B, top wall 140C, and bottom wall 140D. There is no wall between inner space 142 and ink chamber 100 such that inner space 142 is in fluid communication with ink chamber 100. Pivotable member 70 is positioned in ink chamber 100. Pivotable member 70 comprises an indication portion 72 positioned at a first end of pivotable member 70 and a float 73 positioned at a second end of pivotable member 70 opposite the first end of pivotable member 70. Indication portion 72 is configured to be positioned in inner space 142. Pivotable member 70 extends from indication portion 72 to float 73 in a plane substantially parallel to height direction 32 and depth direction 33. Pivotable member 70 comprises a shaft 66 positioned between indication portion 72 and float 73. Shaft 66 extends in width direction 31. Both ends of shaft 66 are supported by bearings (not shown) positioned at inner surfaces of pair of side walls 66, respectively, such that pivotable member 70 pivots about shaft 66. When pair of side walls 60 is a pair of flexible films, the bearings are not positioned at inner surfaces of pair of side walls 66. Instead, shaft 66 is supported by the bearings positioned at frame 50.

Pivotable member 70 is formed of an opaque material. Pivotable member 70 is manufactured by injection-molding a resin, e.g., nylon, polyethylene, polypropylene, polycarbonate, polyolefin, acrylic resin, or the like. A coloring agent, e.g., carbon black may be added in the resin. Alternatively, at least indication portion 72 may be formed of an opaque material, and other portions of pivotable member 70 may be formed of a non-opaque material. When indication portion 72 receives light emitted from optical sensor 230, indication portion 72 is configured to block the light. For example, indication portion 72 prevents the light from passing therethrough. Alternatively, pivotable member 70 may comprise a reflective member, e.g., aluminum foil, positioned at indication portion 72, and when indication portion 72 receives light emitted from optical sensor 230, indication portion 72 reflects the light.

The specific gravity of float 73 is less than the specific gravity of ink in ink chamber 100. In this embodiment, float 73 has a hollow space formed therein. Float 73 is configured to move up and down in accordance with increase and decrease of ink amount in ink chamber 100. In accordance with the movement of float 73, pivotable member 70 pivots about shaft 66. In accordance with the pivot movement of pivotable member 70, indication portion 72 moves up and down in inner space 142.

Figure 3B:
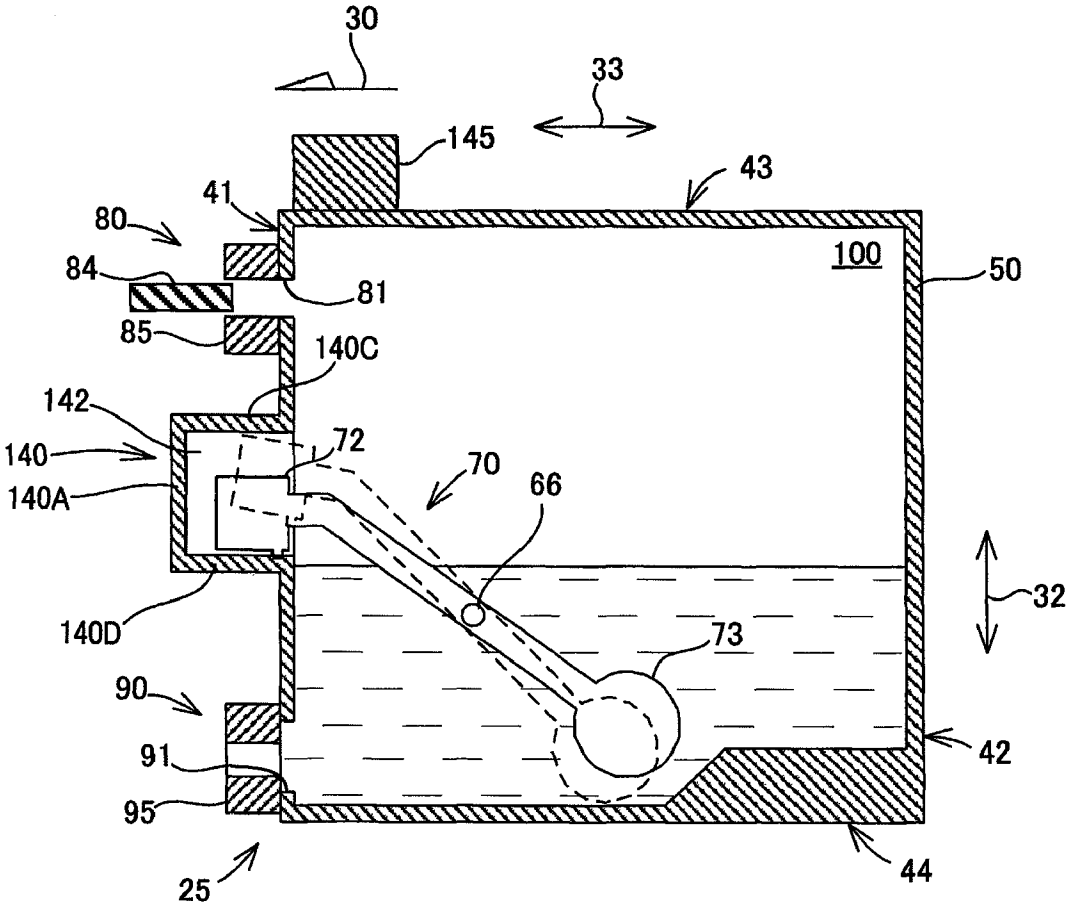
FIG. 3(B) is a side, cross-sectional, view of the ink cartridge of FIGS. 2(A) and 2(B).

When ink chamber 100 has a sufficient amount of ink therein, indicator portion 72 is positioned in a first position in which indicator portion 72 contacts bottom wall 140D as shown in solid line in FIG. 3(B). When ink chamber 100 does not have a sufficient amount of ink therein, indicator portion 72 is positioned in a second position in which indication portion 72 is separated from bottom wall 140D and contacts top wall 140C. In this embodiment, when ink cartridge 25 is mounted to cartridge mounting portion 276 and when indicator portion 72 is positioned in the first position, indicator portion 72 blocks the light emitted from optical sensor 230. By monitoring whether indicator portion 72 is positioned in the first position from an exterior of detection portion 140 by optical sensor 230, it is determined that whether ink chamber 100 has a sufficient amount of ink therein.

Protrusion 145 is positioned at top outer face 43 adjacent to front outer face 41. Protrusion 145 has a plate shape having a depth in depth direction 33, a height in height direction 32, and a width in width direction 31, in which the depth of protrusion 145 is greater than the height of protrusion 145, and the height of protrusion 145 is greater than the width of protrusion 145.

Figure 3A:
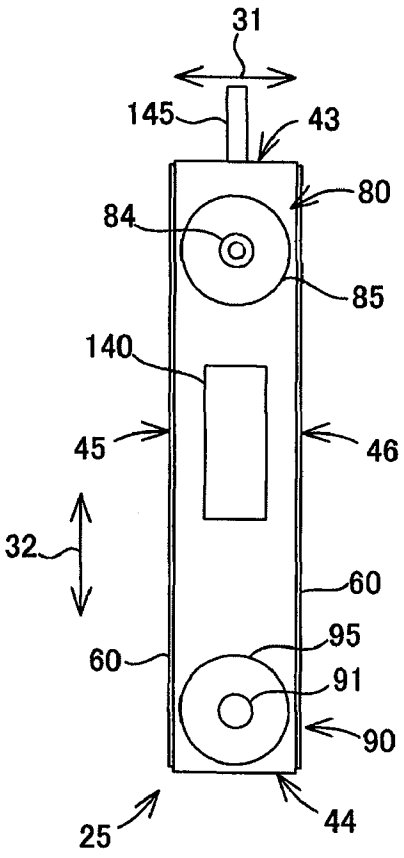
FIG. 3(A) is a front view of the ink cartridge of FIGS. 2(A) and 2(B)

Air communication portion 80 is positioned at front outer face 41. When ink cartridge 25 is mounted to cartridge mounting portion 276, air communication portion 80 is positioned above detection portion 140. Air communication portion 80 comprises an opening 81 formed through front outer face 41 to draw air into ink chamber 100, a valve mechanism configured to selectively be opened and closed such that fluid communication between an interior and an exterior of ink chamber 100 via opening 81 is selectively allowed and prevented, and a cap 85 enclosing the valve mechanism. Cap 85 is attached to front outer face 41 and extends outward from front outer face 41 in a direction away from ink chamber 100, such that the valve mechanism is positioned adjacent to opening 81. In this embodiment, a valve mechanism described in JP-A-2007-144811 or US 2007/0070138 A1 is used as the valve mechanism of air communication portion 80. Nevertheless, another kind of known valve mechanism may be used as the valve mechanism of air communication portion 80. The valve mechanism of air communication portion 80 comprises a rod 84 extending to an exterior of cap 85. Only rod 84 is shown in FIG. 3, and other portions of the valve mechanism is omitted in FIG. 3. When no external force is applied to the valve mechanism, the valve mechanism is closed such that the fluid communication between the interior and the exterior of ink chamber 100 via opening 81 is prevented. When an external force is applied to rod 84 toward ink chamber 100, rod 84 moves toward ink chamber 100 to cause the valve mechanism to be opened such that the fluid communication between the interior and the exterior of ink chamber 100 via opening 81 is allowed. When this occurs, air is drawn into ink chamber 100 via air communication portion 80.

Figure 5:
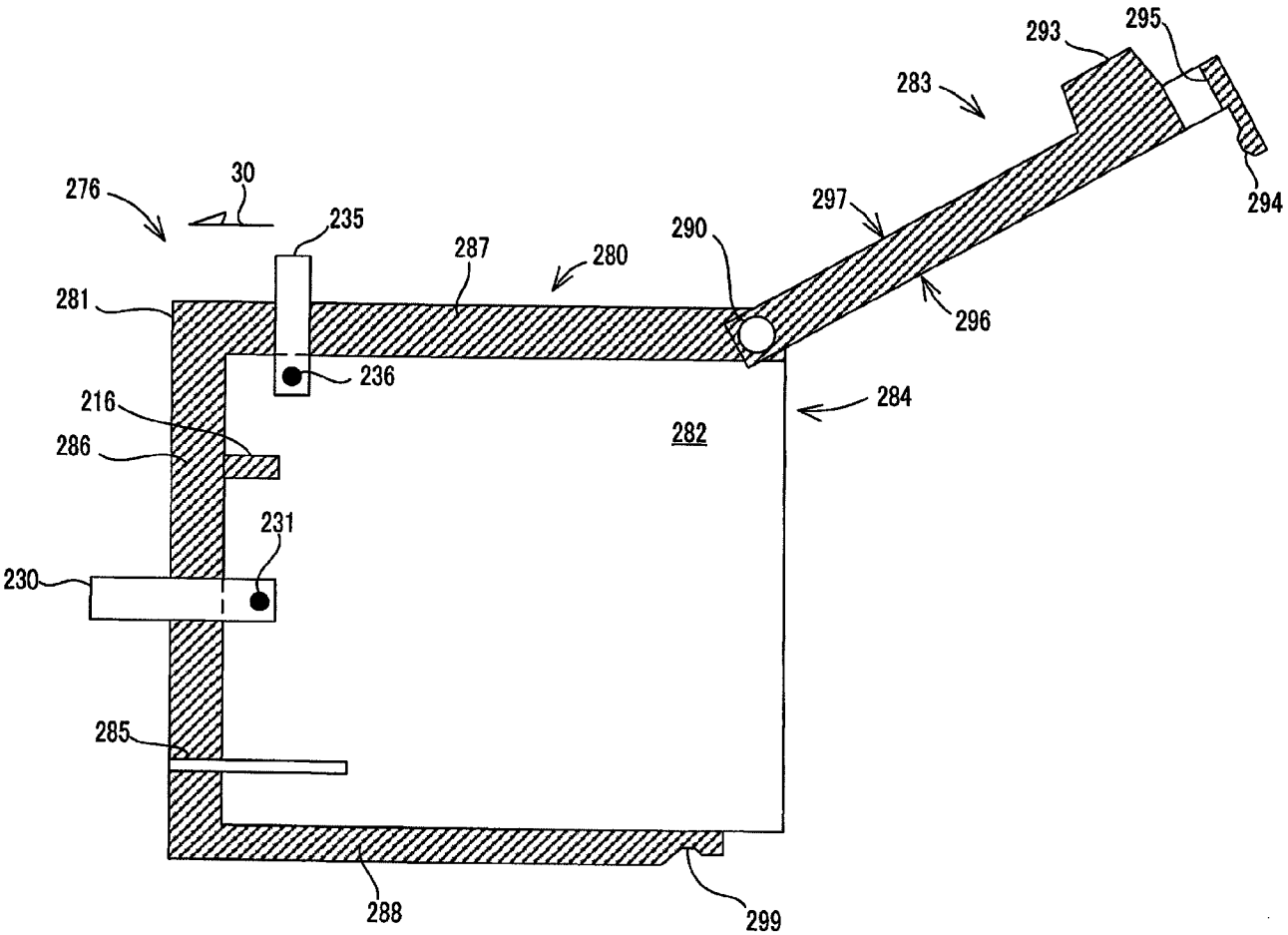
FIG. 5 is a side, partially cross-sectional, view of a cartridge mounting portion according to an embodiment of the invention.

Ink supply portion 90 is positioned at front outer face 41. When ink cartridge 25 is mounted to cartridge mounting portion 276, ink supply portion 90 is positioned below detection portion 140. Ink supply portion 90 has an opening 91 formed through front outer face 41 to supply ink from an interior of ink chamber 100 to an exterior of ink chamber 100, a valve mechanism (not shown) configured to selectively be opened and closed such that fluid communication between the interior and the exterior of ink chamber 100 via opening 91 is selectively allowed and prevented, and a cap 95 enclosing the valve mechanism. Cap 95 is attached to front outer face 41 and extends outward from front outer face 41 in a direction away from ink chamber 100, such that the valve mechanism is positioned adjacent to opening 91. In this embodiment, a valve mechanism described in JP-A-2007-144811 or US 2007/0070138 A1 is used as the valve mechanism of ink supply portion 90. Nevertheless, another kind of known valve mechanism may be used as the valve mechanism of ink supply portion 90. When no external force is applied to the valve mechanism of ink supply portion 90, the valve mechanism is closed such that the fluid communication between the interior and the exterior of ink chamber 100 via opening 91 is prevented. Referring to FIG. 5, cartridge mounting portion 276 comprises an ink pipe 285. When ink cartridge 25 is mounted to cartridge mounting portion 276, ink pipe 285 enters cap 95, such that a portion of ink pipe 285 is positioned within ink supply portion 90, and ink pipe 285 applies a force to, e.g., pushes, the valve mechanism toward ink chamber 100. Consequently, the valve mechanism is opened such that ink is allowed to be supplied from ink chamber 100 to ink pipe 285 via ink supply portion 90, and then supplied to recording head 272 via tube 278.

Figure 4:
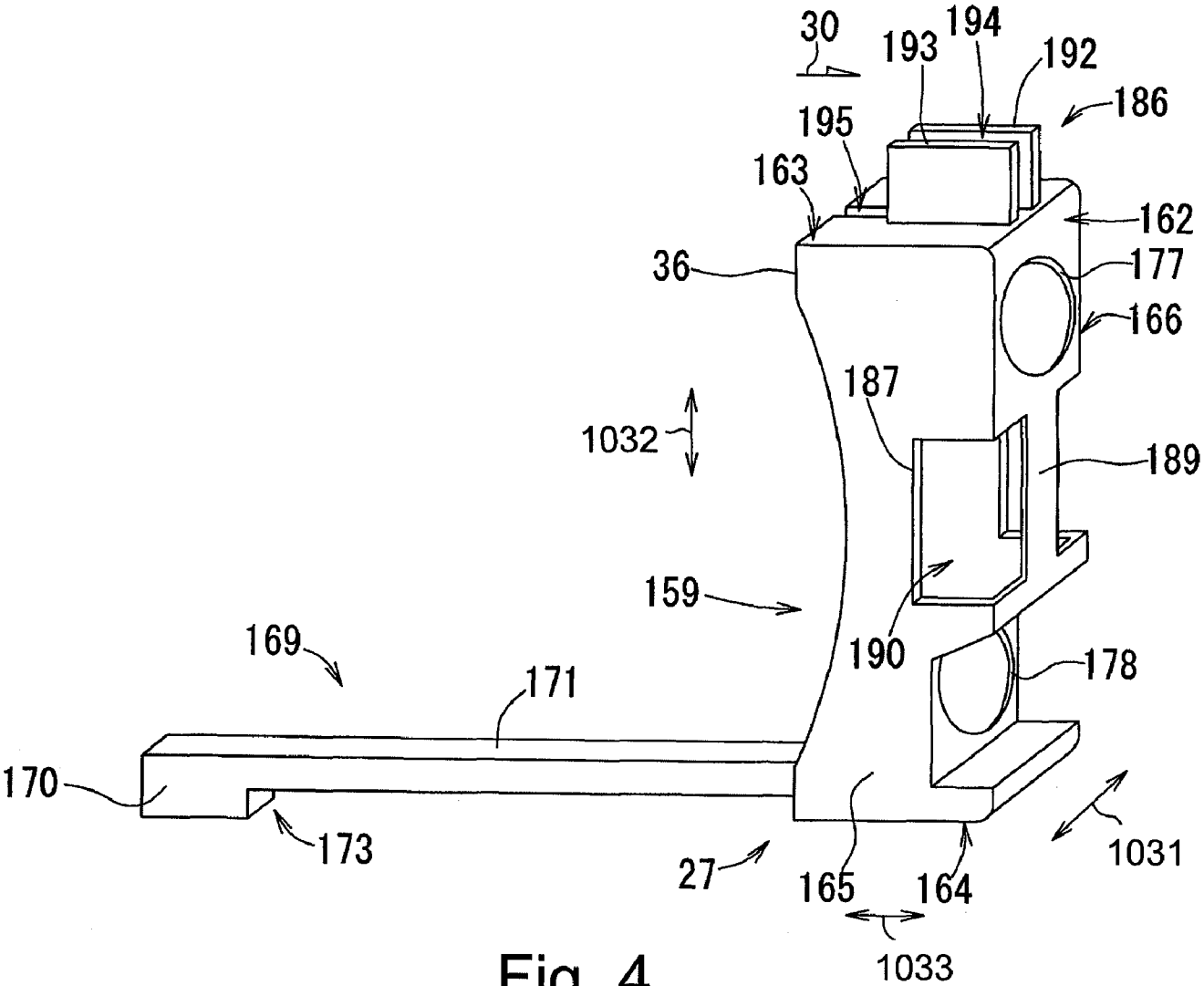
FIG. 4 is a perspective view of an adapter according to an embodiment of the invention.

Referring to FIG. 4, adapter 27 according to an embodiment of the invention is depicted. Adapter 27 is used with ink cartridge 25 in cartridge mounting portion 276. Adapter 27 has information about ink cartridge 25 which is to be used with adapter 27. Recording apparatus 250 is configured to obtain information from detection portions of adapter 27 with optical sensors 230, 235. The information may be related to the color of or the amount of ink stored in ink cartridge 25 which is used with detected adapter 27, or may be related to the country where ink cartridge 25 is sold.

Adapter 27 comprises a main body 36, a detection portion 186, and an operation portion 169.

Figure 2B:
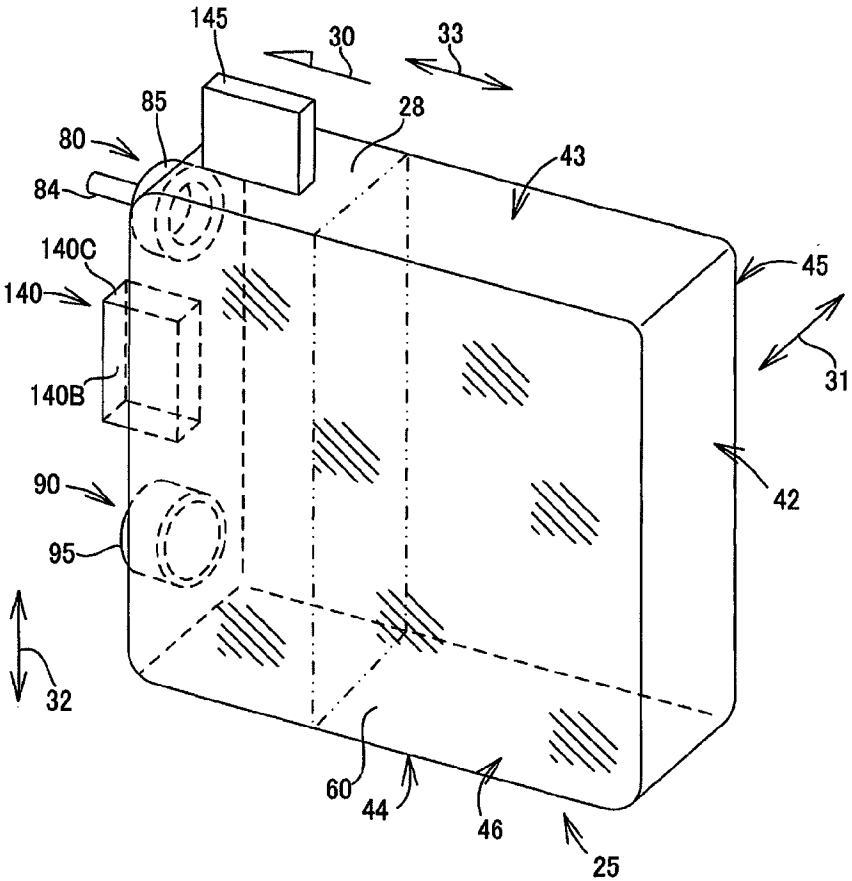
FIGS. 2(A) and 2(B) are perspective views of an ink cartridge according to an embodiment of the invention.
Figure 2A:
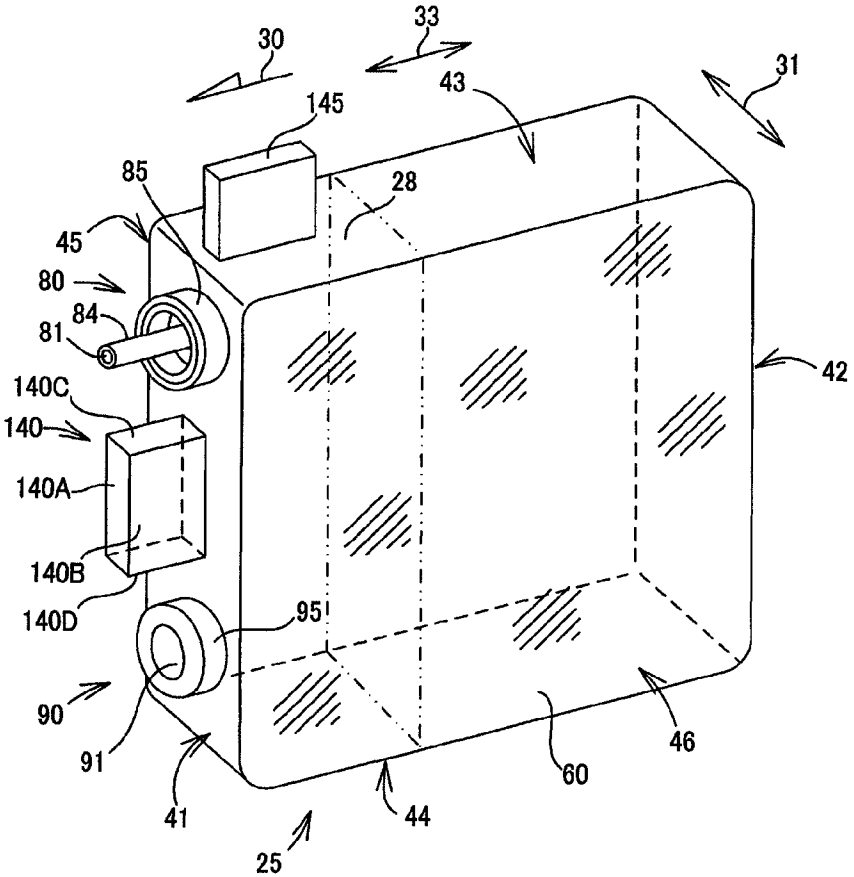

Referring to FIGS. 2(A) and 2(B), ink cartridge 25 comprises a front portion 28 positioned between front outer face 41 and a portion indicated by a alternate long and two short dashes line. Front portion 28 comprises air communication portion 80, detection portion 140, and ink supply portion 90. Referring again to FIG. 4, in this embodiment, main body 36 has a container shape configured to accommodate front portion 28 of ink cartridge 25. In another embodiment, main body 36 may accommodate substantially the entirety of ink cartridge 25. In yet another embodiment, main body 36 may not accommodate any portions of ink cartridge 25.

Main body 36 has a substantially rectangular parallelepiped shape corresponding to the shape of front portion 28 of ink cartridge 25. Main body 36 has a width in a width direction as indicated by an arrow 1031, a height in a height direction as indicated by an arrow 1032, and a depth in a depth direction as indicated by an arrow 1033. The height of main body 36 is greater than each of the width and the depth of main body 36. Main body 36 comprises a front wall 162, a top wall 163, a bottom wall 164 opposite top wall 163, a left side wall 165, and a right side wall 166 opposite left side wall 165. Each of top wall 163 and bottom wall 164 is connected to front wall 162, and each of left side wall 165 and right side wall 166 is connected to front wall 162, top wall 163, and bottom wall 164. Main body 36 has an opening 159 formed opposite front wall 162, and opening 159 is defined by ends of top wall 163, bottom wall 164, left side wall 165, and right side wall 166. Front wall 162, top wall 163, bottom wall 164, left side wall 165, and right side wall 166 define a space therein, and the space is opened to an exterior of main body 36 via opening 159. Front portion 28 of ink cartridge 25 is configured to be inserted into the space of main body 36 via opening 159, and when adapter 27 and ink cartridge 25 are mounted to cartridge mounting portion 276, front portion 28 is accommodated in the space of main body 36. When front portion 28 is accommodated in the space of main body 36, front wall 162 faces front outer face 41 and covers at least a portion of front outer face 41, top wall 163 faces top outer face 43 and covers at least a portion of top outer face 43, bottom wall 164 faces bottom outer face 44 and covers at least a portion of bottom outer face 44, left side wall 165 faces left side outer face 45 and covers at least a portion of left side outer face 45, and right side wall 166 faces right side outer face 46 and covers at least a portion of right side outer face 46. When front portion 28 of ink cartridge 25 is inserted into the space of main body 36, the insertion of front portion 28 is guided by inner surfaces of top wall 163, bottom wall 164, left side wall 165, and right side wall 166, such that the insertion of ink cartridge 25 is performed smoothly. Adapter 27 is inserted into cartridge mounting portion 276 from front wall 162-side in insertion direction 30. When adapter 27 and ink cartridge 25 are mounted to cartridge mounting portion 276, width direction 1031, height direction 1032, and depth direction 1033 are parallel to width direction 31, height direction 32, and depth direction 33, respectively.

Main body 36 has a cut-out 187 formed though front wall 162, left side wall 165, and right side wall 166. When ink cartridge 25 is accommodated in main body 36, detection portion 140 is exposed to the exterior of main body 36 via cut-out 187. Therefore, cut-out 187 is formed at a position corresponding to front wall 140A and pair of side walls 140B, and has a shape and a size corresponding to front wall 140A and pair of side walls 140B. A shape of cut-out 187 at front wall 162 seen from a direction perpendicular to front wall 162 is rectangular, a shape of cut-out 187 at left side wall 165 seen from a direction perpendicular to left side wall 165 is rectangular, a shape of cut-out 187 at right side wall 166 seen from a direction perpendicular to right side wall 166 is also rectangular.

Adapter 27 is formed of an opaque material. Adapter 27 is manufactured by injection-molding a resin, e.g., nylon, polyethylene, polypropylene, polycarbonate, polyolefin, acrylonitrile butadiene styrene. A coloring agent, e.g., carbon black, may be added in the resin.

Main body 36 integrally comprises detection portion 186, and detection portion 186 comprises a pair of protrusions 192, 193. Pair of protrusions 192, 193 is positioned at top wall 163. Pair of protrusions 192, 193 extends from top wall 163 in a direction perpendicular to top wall 163. Each of pair of protrusions 192, 193 has a plate shape having a depth in depth direction 1033, a height in height direction 1032, and a width in width direction 1031, in which the height of each of pair of protrusions 192, 193 is greater than the width of each of pair of protrusions 192, 193, and the depth of each of pair of protrusions 192, 193 is greater than the height of each of pair of protrusions 192, 193. When adapter 27 is inserted into cartridge mounting portion 276 and mounted to cartridge mounting portion 276, detection portion 186 is positioned in an optical path 236 of an optical sensor 235 provided in cartridge mounting portion 276, and blocks light emitted from optical sensor 235. Optical path 236 is formed between a light emitting portion and a light receiving portion of optical sensor 235. The light emitting portion and the light receiving portion of optical sensor 235 faces each other. Because adapter 27 is formed of opaque material, detection portion 186 blocks light, e.g., visible or infrared light, emitted from the light emitting portion. For example, when detection portion 186 is positioned in optical path 236 of optical sensor 235, detection portion 186 prevents the light of optical sensor 235 from passing therethrough. Alternatively, adapter 27 may comprise a reflective member, e.g., aluminum foil, positioned at detection portion 186, and when detection portion 186 receives light emitted from optical sensor 235, detection portion 186 reflects the light. Optical sensor 235 is electrically connected to a controller (not shown) of recording apparatus 250. When the light emitted from the light emitting portion is not blocked, the intensity of the light reaching the light receiving portion is greater than a threshold value. When detection portion 186 blocks the light emitted from the light emitting portion, the intensity of the light reaching the light receiving portion is less than the threshold value. When the intensity of the light reaching the light receiving portion is less than the threshold value, optical sensor 235 outputs a signal to the controller, and the controller determines that adapter 27 is mounted to cartridge mounting portion 276. Protrusion 192 and protrusion 193 are aligned in width direction 1031, and a gap 194 is formed therebetween. Top wall 163 has a slit 195 formed therethrough extending from opening 159 in depth direction 1033. Slit 195 is continuous with gap 194.

Main body 36 comprises a bridge portion 189 positioned at front wall 162 and spanning cut-out 187 in height direction 1032. Bridge portion 189 has a plate shape having a depth in depth direction 1033, a height in height direction 1032, and a width in width direction 1031, in which the width of bridge portion 189 is greater than the depth of bridge portion 189, and the height of bridge portion 189 is greater than the width of bridge portion 189. Bridge portion 189 divides cut-out 187 into two openings 190. When bridge portion 189 is inserted into cartridge mounting portion 276, bridge portion 189 passes an optical path 231 of optical sensor 230, and blocks light emitted from optical sensor 230. Optical path 231 is formed between a light emitting portion and a light receiving portion of optical sensor 230. The light emitting portion and the light receiving portion of optical sensor 230 faces each other. Because adapter 27 is formed of opaque material, bridge portion 189 blocks light, e.g., visible or infrared light, emitted from the light emitting portion. For example, when bridge portion 189 is positioned in optical path 231 of optical sensor 230, bridge portion 189 prevents the light of optical sensor 230 from passing therethrough. Alternatively, adapter 27 may comprise a reflective member, e.g., aluminum foil, positioned at bridge portion 189, and when bridge portion 189 receives light emitted from optical sensor 230, bridge portion 189 reflects the light. When the insertion of adapter 27 into the cartridge mounting portion 276 is completed, the light emitting portion and the light receiving portion of optical sensor 230 faces openings 190, respectively, such that the light emitted from the light emitting portion may reach the light receiving portion though openings 190. Optical sensor 230 is electrically connected to a controller (not shown) of recording apparatus 230. When the light emitted from the light emitting portion is not blocked, the intensity of the light reaching the light receiving portion is greater than a threshold value. When bridge portion 189 blocks the light emitted from the light emitting portion, the intensity of the light reaching the light receiving portion is less than the threshold value. When the intensity of the light reaching the light receiving portion is less than the threshold value, optical sensor 230 outputs a signal to the controller.

The depth of bridge portion 189 depends on the characteristic of ink cartridge 25 which is to be used with adapter 27, e.g., the color of or the initial amount of ink stored in ink chamber 100 of ink cartridge 25 which is to be used with adapter 27. In this embodiment, two types of ink cartridge 25 are used. One type of ink cartridge 25 stores a relatively small initial amount of ink in ink chamber 100, and another type of ink cartridge 25 stores a relatively large initial amount of ink in ink chamber 100. The depth of bridge portion 189 of adapter 27 to be used with ink cartridge 25 storing the relatively large initial amount of ink is greater than the depth of bridge portion 189 of adapter 27 to be used with ink cartridge 25 storing the relatively small initial amount of ink. Alternatively, one type of ink cartridge 25 stores a black ink in ink chamber 100, and another type of ink cartridge 25 stores a color ink other than black in ink chamber 100. The depth of bridge portion 189 of adapter 27 to be used with ink cartridge 25 storing the black ink is greater than the depth of bridge portion 189 of adapter 27 to be used with ink cartridge 25 storing the color ink.

Front wall 162 has a circular opening 177 formed therethrough in depth direction 1033. Opening 177 is positioned adjacent to top wall 163. The space defined by front wall 162, top wall 163, bottom wall 164, left side wall 165, and right side wall 166 is opened to the exterior of main body 36 via opening 177. Opening 177 is formed at a position corresponding to air communication portion 80. Referring to FIG. 5, cartridge mounting portion 276 comprises a pushing portion 216, and the diameter of opening 177 is great enough to allow pushing portion 216 to be inserted through opening 177. When adapter 27 is mounted to cartridge mounting portion 276, a portion of pushing portion 216 is positioned within opening 177. Then, when ink cartridge 25 is inserted into cartridge mounting portion 276, pushing portion 216 applies a force to rod 84, e.g., pushes, rod 84 toward ink chamber 100 to cause the valve mechanism of air communication portion 80 to be opened.

Referring again to FIG. 4, front wall 162 has a circular opening 178 formed therethrough in depth direction 1033. Opening 178 is positioned adjacent to bottom wall 164. The space defined by front wall 162, top wall 163, bottom wall 164, left side wall 165, and right side wall 166 is opened to the exterior of main body 36 via opening 178. Opening 178 is formed at a position corresponding to ink supply portion 90. The diameter of opening 178 is great enough to allow ink supply portion 90 to be inserted through opening 178. When adapter 27 and ink cartridge 25 are mounted to cartridge mounting portion 276, a portion of ink supply portion 90 is positioned within opening 178, and a portion of ink pipe 285 is positioned within ink supply portion 90.

Operation portion 169 has a substantially rectangular parallelepiped shape having a depth in depth direction 1033, a height in height direction 1032, and a width in width direction 1033, in which the depth of operation portion 169 is greater than each of the height and the width of operation portion 169. The width of operation portion 169 is less than the width of main body 36. Operation portion 169 extends from bottom wall 164 in a direction away from main body 36. Operation portion 169 comprises an extending portion 171 and a grasp portion 170. Extending portion 171 has a first end connected to main body 36 and a second end opposite the first end of extending portion 171. Grasp portion 170 is connected to the second end of extending portion 171. A user 170 may grasp portion 170. Each of grasp portion 170 and extending portion 171 has a height in height direction 1032, and the height of grasp portion 170 is greater than the height of extending portion 171. Each of grasp portion 170 and extending portion 171 has a top surface and a bottom surface opposite bottom surface. When adapter 27 is mounted to cartridge mounting portion 276, the top surface of each of grasp portion 170 and extending portion 171 is positioned above the bottom surface of each of grasp portion 170 and extending portion 171. The top surface of grasp portion 170 is flush with the top surface of extending portion 171, and the bottom surface of grasp portion 170 is offset from the bottom surface of extending portion 171, such that the bottom surface of grasp portion 170 is connected to the bottom surface of extending portion via a connecting surface 173 extending in height direction 1032. In another embodiment, operation portion 169 may not be connected to bottom wall 164, but may be connected to top wall 163, left side face 165, or right side wall 166.

Referring to FIGS. 5-13, cartridge mounting portion 276 according to an embodiment of the invention is depicted. Cartridge mounting portion 276 comprises at least one case 280, e.g., four cases 280 corresponding to four ink cartridges 25, respectively. Case 280 comprises a main body 281 and a lock lever 283. Main body 281 has an accommodating chamber 282 formed therein. Accommodating chamber 282 is configured to receive and accommodate ink cartridge 25 and adapter 27. Case 280 has an opening 284 formed therethrough and a end wall 286 positioned opposite opening 284. Adapter 27 is inserted into accommodating chamber 282 via opening 284 to be positioned to contact end wall 286 with front wall 162 facing end wall 286, and then ink cartridge 25 is inserted into accommodating chamber 282 via opening 284 such that front portion 28 of ink cartridge 25 is positioned in main body 36 of adapter 27.

Case 280 comprises optical sensor 230 and optical sensor 235, e.g., photo interrupters. Optical sensor 230 is positioned at end wall 286 of case 280. Case 280 comprises a top wall 287 and a bottom wall 288 opposite top wall 287, and optical sensor 235 is positioned at top wall 287 adjacent to end wall 286. Each of optical sensor 230 and optical sensor 235 comprises a light emitting portion and a light receiving portion. Each of optical sensor 230 and optical sensor 235 is connected to a controller (not shown) of recording apparatus 250, and is configured not to output an electric signal to the controller when the light receiving portion receives light having intensity of equal to or greater than a threshold value, but to output the electric signal to the controller when the light receiving portion receives light having intensity of less than the threshold value. Optical path 231 is formed between the light emitting portion and the light receiving portion of optical sensor 230. The light emitting portion and the light receiving portion of optical sensor 230 is aligned in a direction perpendicular to the paper plane of FIG. 5, and the light emitting portion and the light receiving portion of optical sensor 230 face each other. Similarly, optical path 236 is formed between the light emitting portion and the light receiving portion of optical sensor 235. The light emitting portion and the light receiving portion of optical sensor 235 is aligned in a direction perpendicular to the paper plane of FIG. 5, and the light emitting portion and the light receiving portion of optical sensor 235 faces each other.

When bridge portion 189 or indication portion 72 is positioned in optical path 231, the light emitted from the light emitting portion of optical sensor 230 is blocked, and the light receiving portion of optical sensor 230 receives light having intensity of less than the threshold value, e.g., zero intensity. Similarly, when detection portion 186 is positioned in optical path 236, the light emitted from the light emitting portion of optical sensor 235 is blocked, and the light receiving portion of optical sensor 235 receives light having intensity of less than the threshold value, e.g., zero intensity.

Case 280 comprises ink pipe 285 extending from end wall 286 toward opening 284 in a direction opposite insertion direction 30. Ink pipe 285 penetrates through end wall 286, and an end of ink pipe 285 is exposed to the exterior of main body 281. Tube 278 is connected to the end of ink pipe 285. When ink cartridge 25 is accommodated in accommodating chamber 282, ink pipe 285 enters ink supply portion 90, such that the valve mechanism of ink supply portion 90 is opened by ink pipe 285. When the valve mechanism of ink supply portion 90 is opened by ink pipe 285, ink chamber 100 is brought into fluid communication with ink pipe 285, and ink is allowed to be supplied from ink chamber 100 to recording head 272 via opening 91, ink pipe 285, and tube 278.

Case 280 comprises a pushing portion 216 extending from end wall 286 toward opening 284 in a direction opposite insertion direction 30. When adapter 27 is inserted into accommodating chamber 282, pushing portion 216 is inserted through opening 177. Then, when ink cartridge 25 is inserted into accommodating chamber 282, pushing portion 216 applies a force to rod 84, e.g., pushes rod 84 toward ink chamber 100 to cause the valve mechanism of air communication portion 80 to be opened.

Lock lever 283 is configured to be selectively opened and closed to selectively cover and uncover opening 284. When adapter 27 and ink cartridge 25 are accommodated in accommodating chamber 282, and lock lever 283 is closed, adapter 27 and ink cartridge 25 are securely retained in accommodating chamber 282 by lock lever 283. Case 280 comprises a shaft 290 positioned directly above opening 284, and a first end of lock lever 283 is coupled to shaft 290, such that lock lever 283 pivots about shaft 290. Lock lever 283 has an inner surface 296 and an outer surface 297 opposite inner surface 296. When lock lever 283 covers opening 284, inner surface 296 faces accommodating chamber 282. Lock lever 283 comprises an operation portion 293, and a claw 294. Claw 294 is positioned at inner surface 296 and at a second end of lock lever 283 opposite the first end of lock lever 283. Operation portion 293 is positioned at outer surface 297 adjacent to the second end of lock lever 283. Lock lever 290 has an opening 295 extending from inner surface 296 to outer surface 297 and positioned adjacent to the second end of lock lever 283. Case 280 has a groove 299 formed therein at a position below opening 284, and groove 299 is configured to engage claw 294.

Referring to FIGS. 6-13, adapter 27 and ink cartridge 25 are inserted into accommodating chamber 282 and mounted to case 280 in the following manner.

Figure 6:
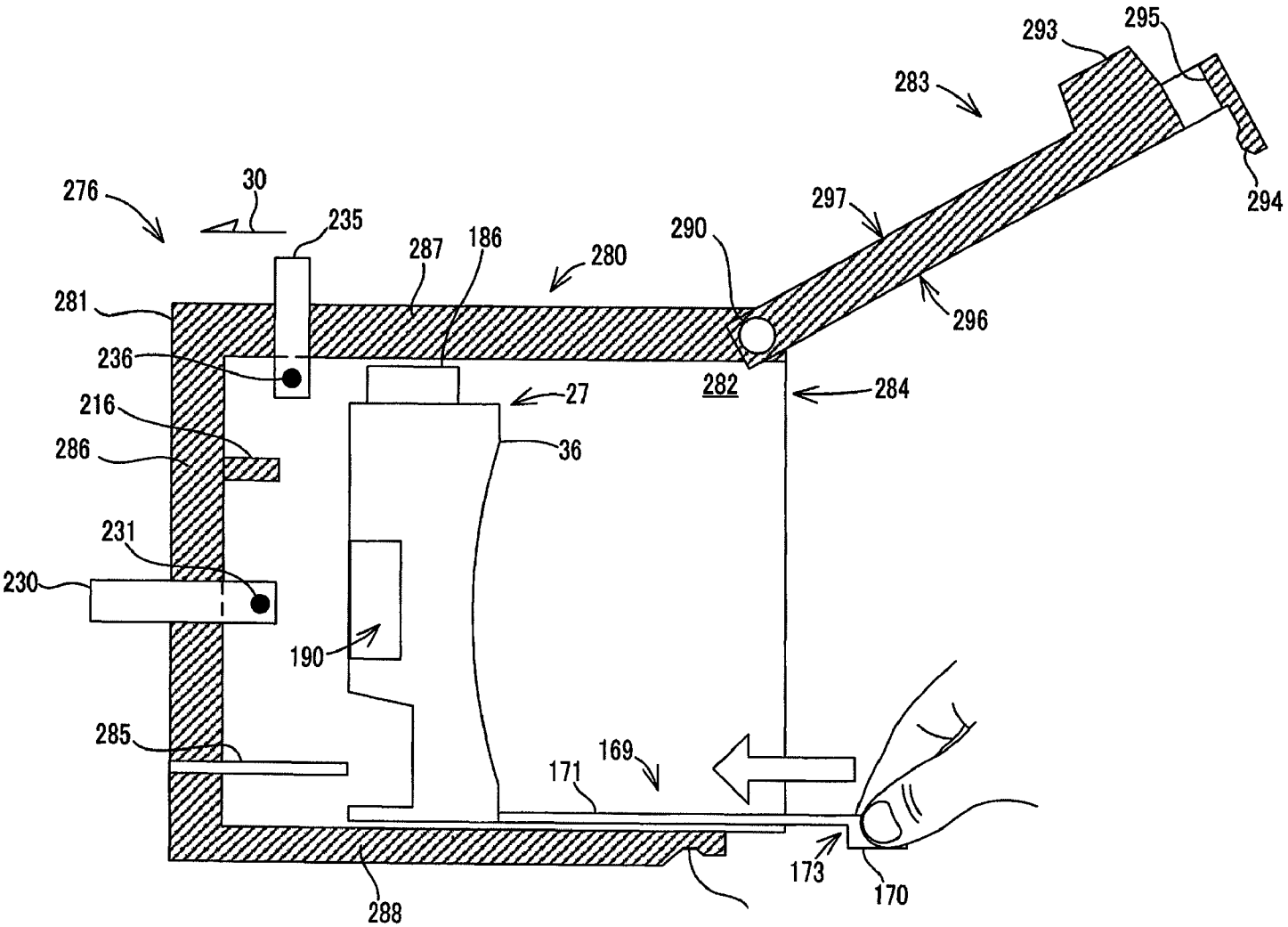
FIG. 6 is a side, partially cross-sectional, view of the cartridge mounting portion of FIG. 5 and the adapter of FIG. 4, in which the adapter is being inserted into the cartridge mounting portion.
Figure 7:
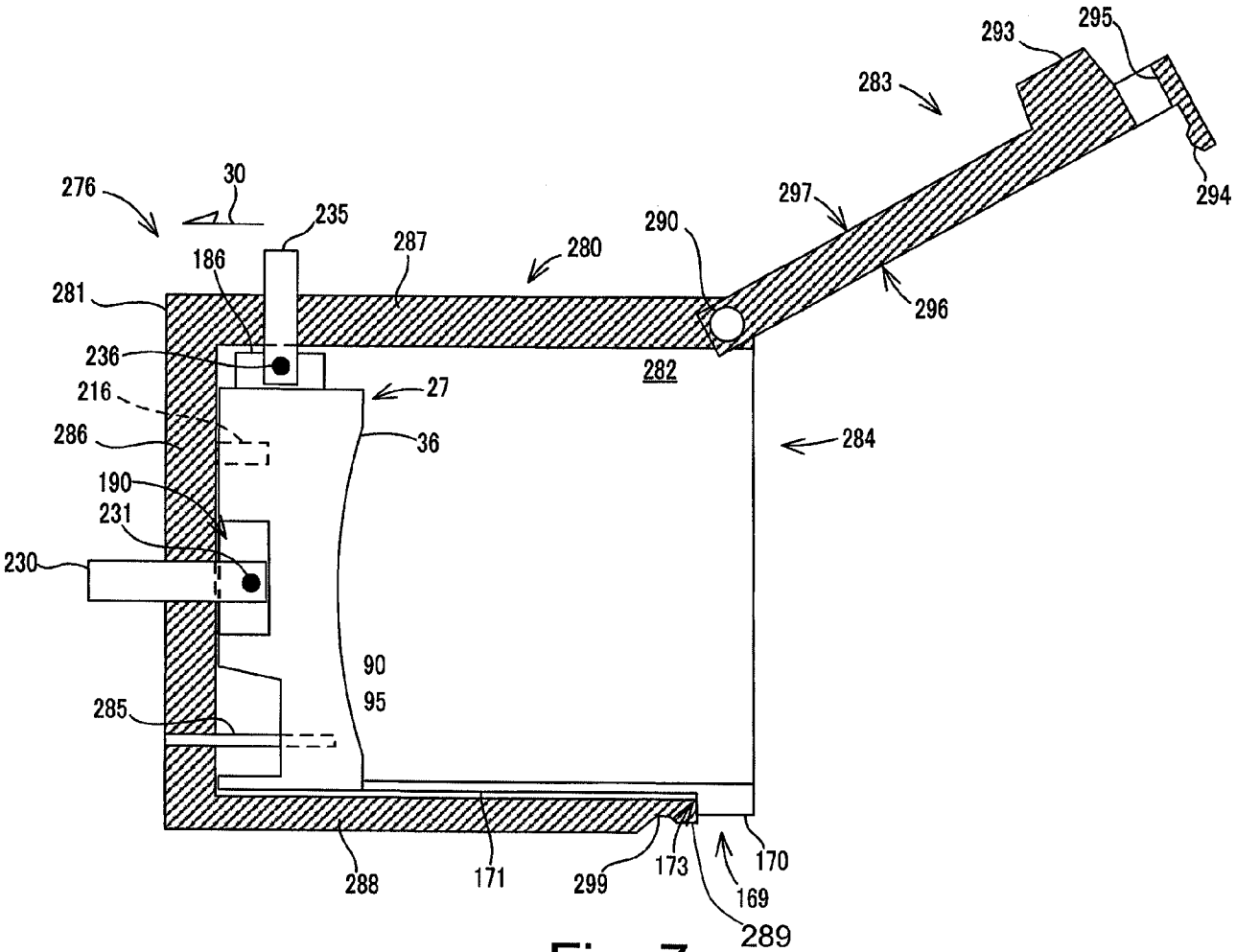
FIG. 7 is a side, partially cross-sectional, view of the cartridge mounting portion of FIG. 5 and the adapter of FIG. 4, in which the insertion of the adapter into the cartridge mounting portion is completed.

When a user intends to insert adapter 27 into accommodating chamber 282, the user grasps grasp portion 170 as shown in FIG. 6, and inserts adapter 27 into accommodating chamber 282 from front wall 162-side via opening 284 toward end wall 286. Bridge portion 189 first enters optical path 231 of optical sensor 230, and then when adapter 27 is further inserted, detection portion 186 enters optical path 236 of optical sensor 235. If adapter 27 is the one used with ink tank 25 storing the relatively large initial amount of ink or storing the black ink, the depth of bridge portion 189 is great enough such that bridge portion 189 is still positioned in optical path 231 of optical sensor 230 when detection portion 186 initially enters optical path 236 of optical sensor 235. On the contrary, if adapter 27 is the one used with ink tank 25 storing the relatively small initial amount of ink or storing the color ink, the depth of bridge portion 189 is short such that bridge portion 189 has passed optical path 231 of optical sensor 230 and is not positioned in optical path 231 of optical sensor 230 when detection portion 186 initially enters optical path 236 of optical sensor 235. The controller determines which type of ink tank 25 is to be mounted based on the output of optical sensor 230 when detection portion 186 initially enters optical path 236 of optical sensor 235. When adapter 27 is further inserted, adapter 27 contacts end wall 286 as shown in FIG. 7, which completes the insertion of adapter 27. When adapter 27 contacts end wall 286, detection portion 186 is positioned in optical path 236 of optical sensor 235, optical path 231 of optical sensor 230 is positioned through openings 190, and a portion of pushing portion 216 is positioned within opening 177 as shown in FIG. 7. Moreover, when adapter 27 contacts end wall 286, operation member 169 extends from bottom wall 164 of main body 36 to opening 284, such that grasp portion 170 is positioned outside accommodating chamber 282, and connecting surface 173 contacts an end surface 289 of bottom wall 288 positioned opposite end wall 286. The controller determines whether adapter 27 is mounted in case 280 based on the output of optical sensor 235.

Figure 8:
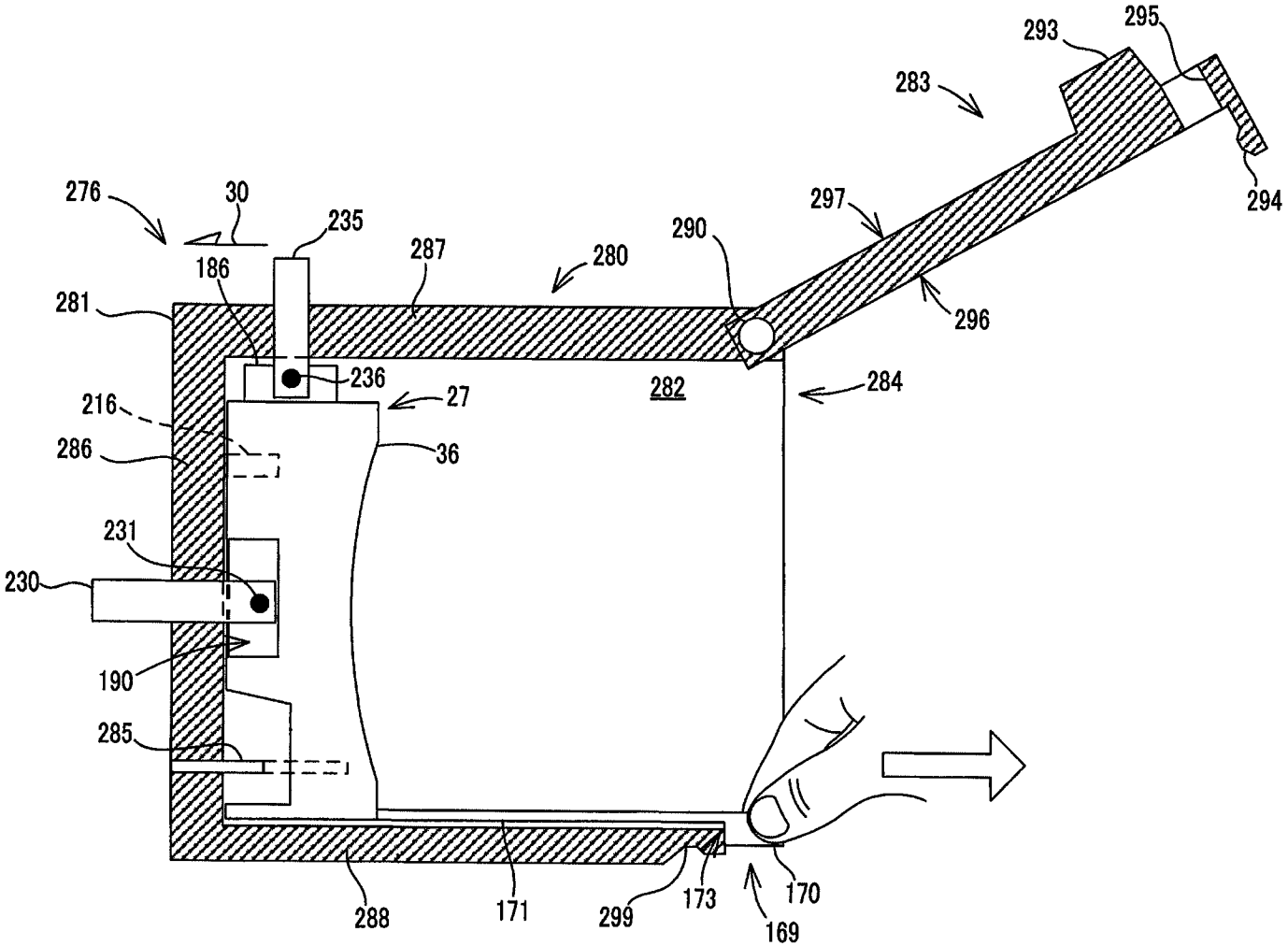
FIG. 8 is a side, partially cross-sectional, view of the cartridge mounting portion of FIG. 5 and the adapter of FIG. 4, in which the adapter is being removed from the cartridge mounting portion.

When a user intends to remove adapter 27 from case 280 before inserting ink cartridge 25 into accommodating chamber 282, the user grasps grasp portion 170 as shown in FIG. 8, and pulls adapter 27 in a direction opposite to insertion direction 30.

Figure 9:
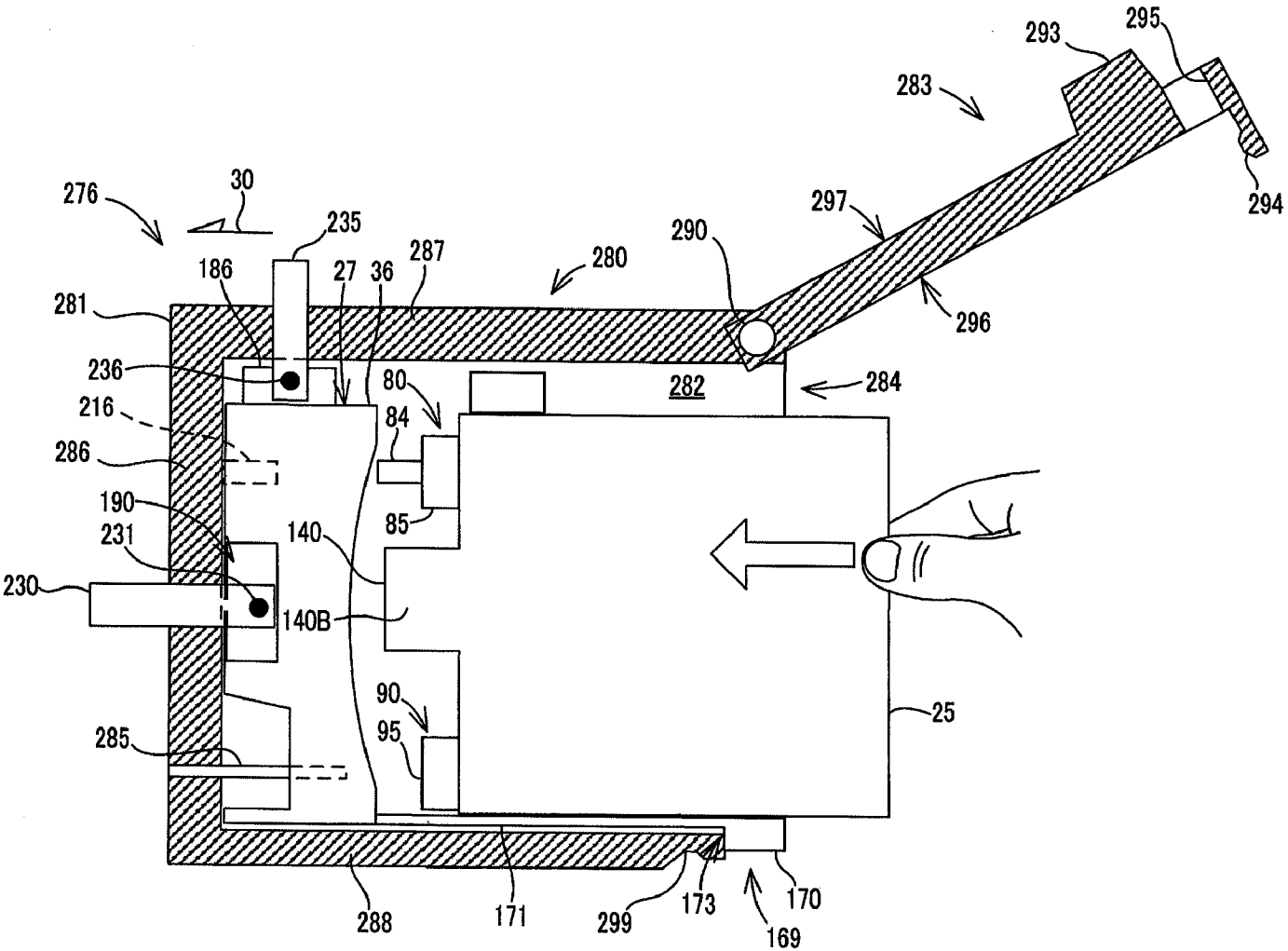
FIG. 9 is a side, partially cross-sectional, view of the cartridge mounting portion of FIG. 5, the adapter of FIG. 4, and the ink cartridge of FIGS. 2(A) and 2(B), in which the insertion of the adapter into the cartridge mounting portion is completed, and the ink cartridge is being inserted into the cartridge mounting portion.

After the insertion of adapter 27 into accommodating chamber 282 is completed, ink cartridge 25 is inserted into accommodating chamber 282 from front outer face 41-side via opening 284 toward end wall 286 while bottom outer surface 44 sliding on the top surface of extending portion 171 as shown in FIG. 9, and then front portion 28 of ink cartridge 25 is inserted into the space of main body 36 of adapter 27 via opening 159 of main body 36 of adapter 27.

Figure 10:
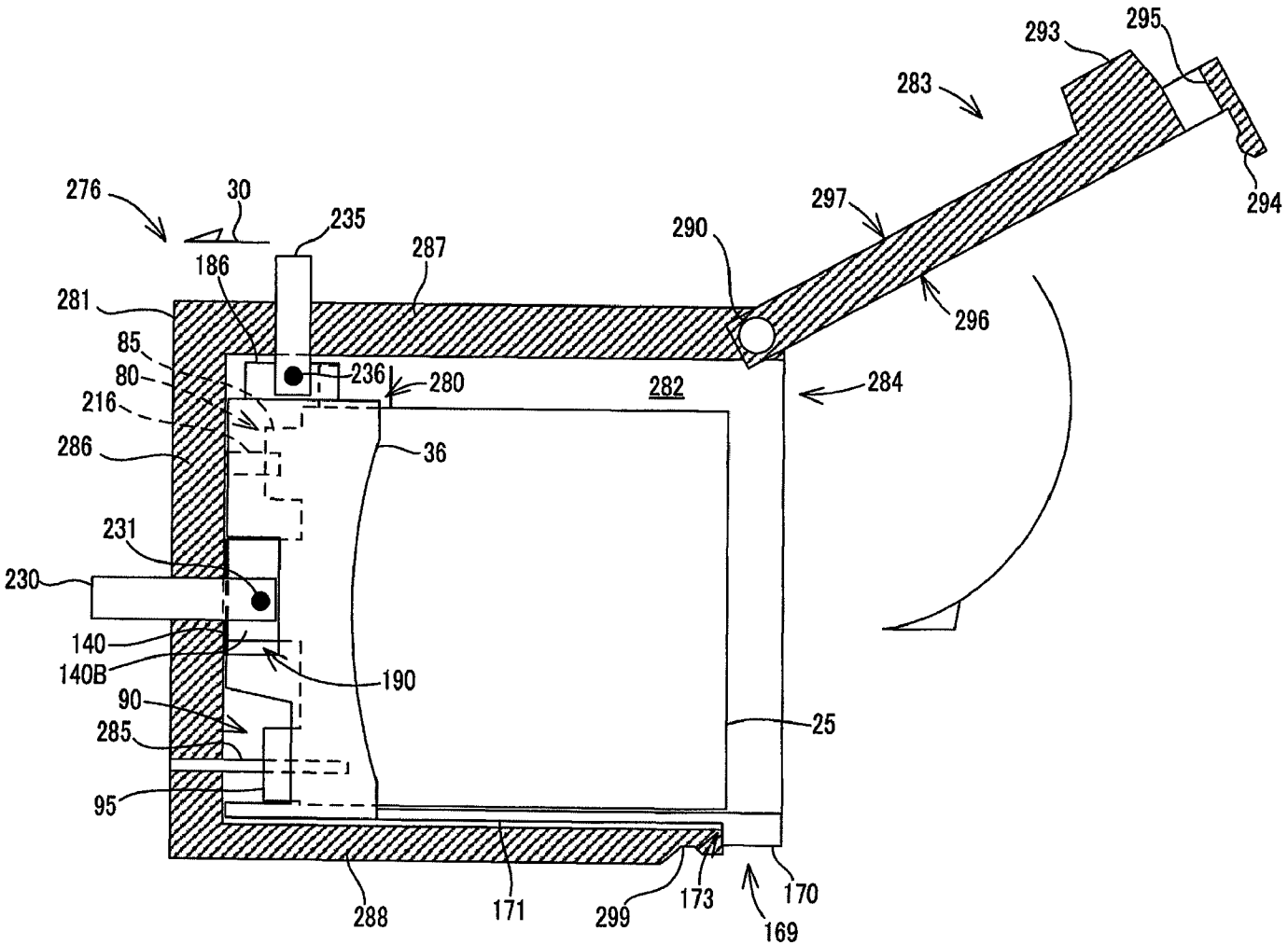
FIG. 10 is a side, partially cross-sectional, view of the cartridge mounting portion of FIG. 5, the adapter of FIG. 4, and the ink cartridge of FIGS. 2(A) and 2(B), in which the insertion of the adapter into the cartridge mounting portion is completed, and the insertion of the ink cartridge into the cartridge mounting portion is completed.

During the insertion of ink cartridge 25, protrusion 145 is inserted into gap 194 and slit 195. Pushing portion 216 then applies a force to rod 84, e.g., contacts and pushes rod 84 toward ink chamber 100 to cause the valve mechanism of air communication portion 80 to be opened. Ink chamber 100 is brought into fluid communication with the atmosphere via opening 81, and air is drawn into ink chamber 100 via air communication portion 80. Ink supply portion 90 then enters opening 178, and ink pipe 285 enters ink supply portion 90, such that the valve mechanism of ink supply portion 90 is opened by ink pipe 285. Ink chamber 100 is brought into fluid communication with ink pipe 285, and ink is allowed to be supplied from ink chamber 100 to recording head 272 via opening 91, ink pipe 285, and flexible tube 278. When ink cartridge 25 is inserted to the end, detection portion 140 is exposed to the exterior of main body 36 of adapter 27 via openings 190, and detection portion 140 is positioned in optical path 231 of optical sensor 230 as shown in FIG. 10. When indication portion 72 is positioned in optical path 231, the controller of recording apparatus 250 determines that ink chamber 100 has a sufficient amount of ink therein, and when indication portion 72 is not positioned in optical path 231, the controller determines that ink chamber 100 does not have a sufficient amount of ink therein, based on the output from optical sensor 230.

Figure 11:
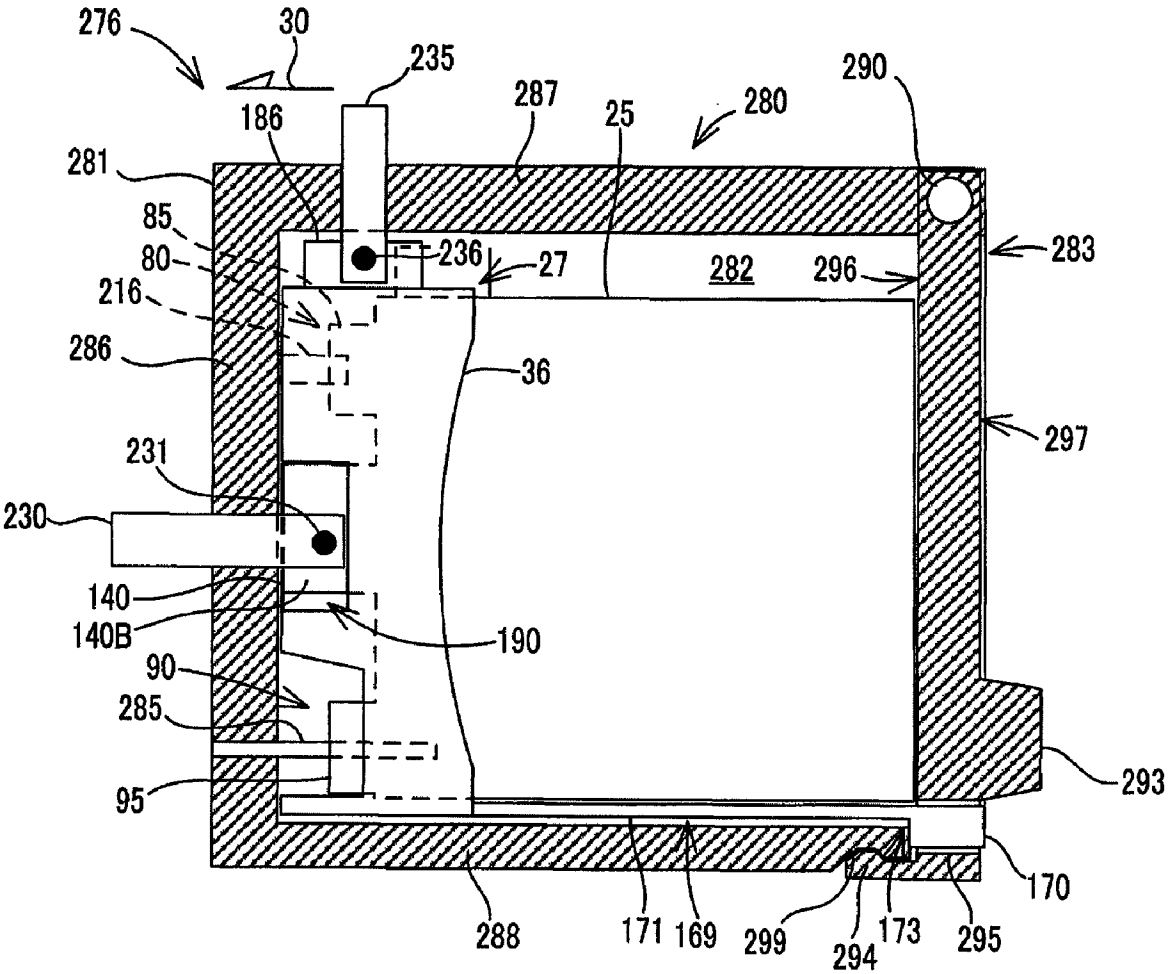
FIG. 11 is a side, partially cross-sectional, view of the cartridge mounting portion of FIG. 5, the adapter of FIG. 4, and the ink cartridge of FIGS. 2(A) and 2(B), in which the insertion of the adapter into the cartridge mounting portion is completed, the insertion of the ink cartridge into the cartridge mounting portion is completed, and a lock lever of the cartridge mounting portion is secured to a case of the cartridge mounting portion.

Subsequently, lock lever 283 pivots toward opening 284 by a user pushing operation portion 293. When the second end of lock lever 283 moves toward groove 299 and claw 294 engages groove 299, lock lever 283 is closed and secured to main body 281 as shown in FIG. 11. After lock lever 283 is closed, rear outer face 42 of ink cartridge 25 contacts inner surface 296 of lock lever 283, and therefore ink cartridge 25 is securely retained in case 280. Grasp portion 170 is positioned in opening 295 of lock lever 283.

Figure 12:
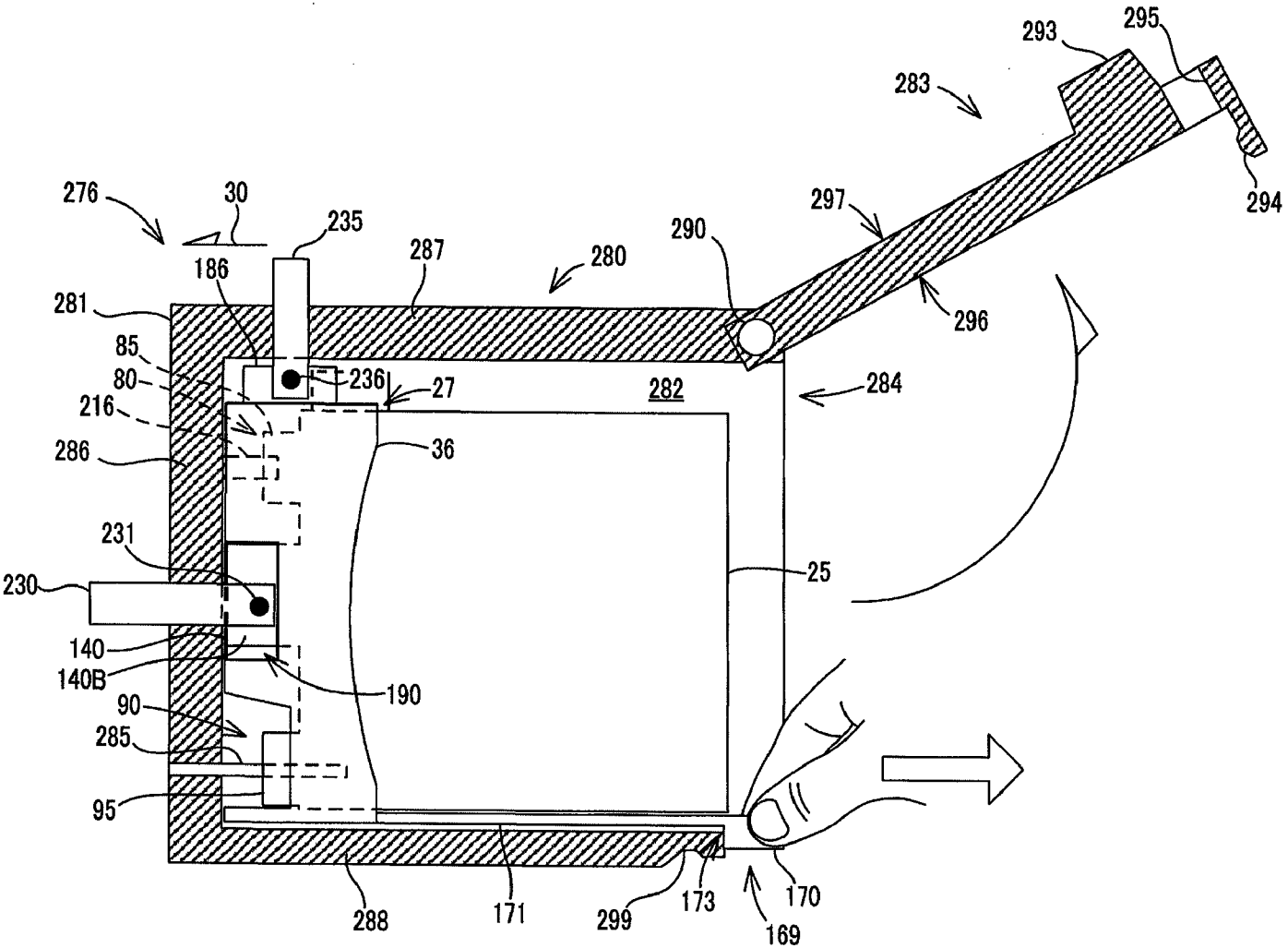
FIG. 12 is a side, partially cross-sectional, view of the cartridge mounting portion of FIG. 5, the adapter of FIG. 4, and the ink cartridge of FIGS. 2(A) and 2(B), in which the adapter and the ink cartridge start to be removed.
Figure 13:
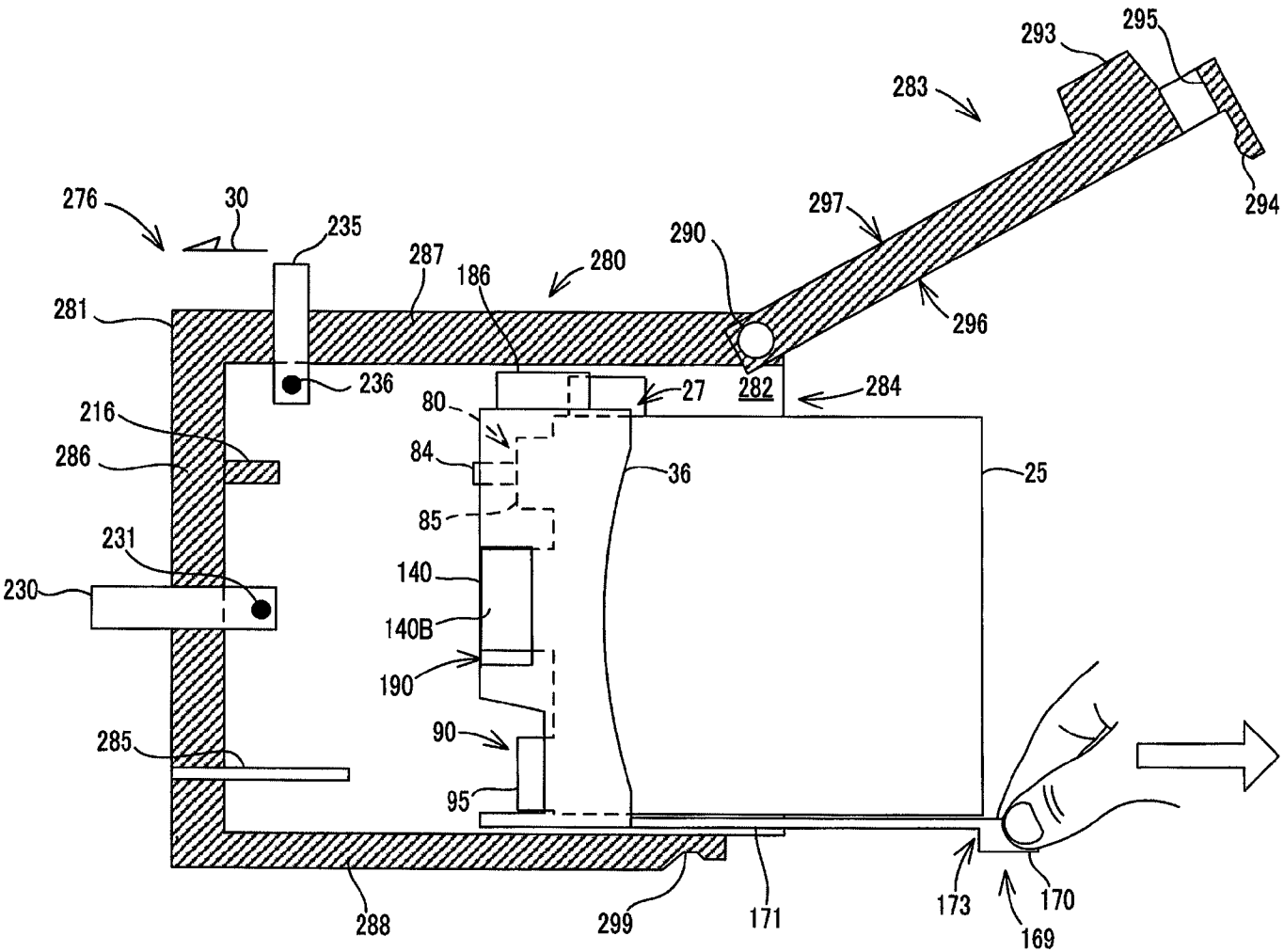
FIG. 13 is a side, partially cross-sectional, view of the cartridge mounting portion of FIG. 5, the adapter of FIG. 4, and the ink cartridge of FIGS. 2(A) and 2(B), in which the adapter and the ink cartridge are being removed.

When ink cartridge 25 is removed from case 280, a user disengages claw 294 from groove 299, and causes lock lever 283 to pivot upward. The user grasps grasp portion 170 as shown in FIG. 12, and pulls adapter 27 in a direction opposite to insertion direction 30. Because front portion 28 of ink cartridge 25 is accommodated in the space of main body 36 of adapter 27, ink cartridge 25 moves toward opening 284 together with adapter 27 as shown in FIG. 13. Therefore, the user can readily remove ink cartridge 25 from case 280.

Because the information about the characteristic of ink cartridge 25 is carried by adapter 27 as the depth of bridge portion 189, a common ink cartridge 25 can be used regardless of the characteristic of ink cartridge 25. When ink cartridge 25 is used up, and if a user wishes to use a new ink cartridges 25 having the same characteristic as the used ink cartridge 25, the user does not have to purchase a new adapter 27. The user only has to purchase a new ink cartridge 25, and the user can use the new ink cartridge 25 with adapter 27 which the user has already had.

Because the space, openings 177, 178 are formed in main body 36 of adapter 27, ink cartridge 25 can be mounted to case 280 after adapter 27 is mounted to case 280. Moreover, ink cartridge 25 moves toward opening 284 together with adapter 27 when a user grasps grasp portion 170 and pulls adapter 27. Therefore, the user can readily remove ink cartridge 25 from case 280.

Figure 14:
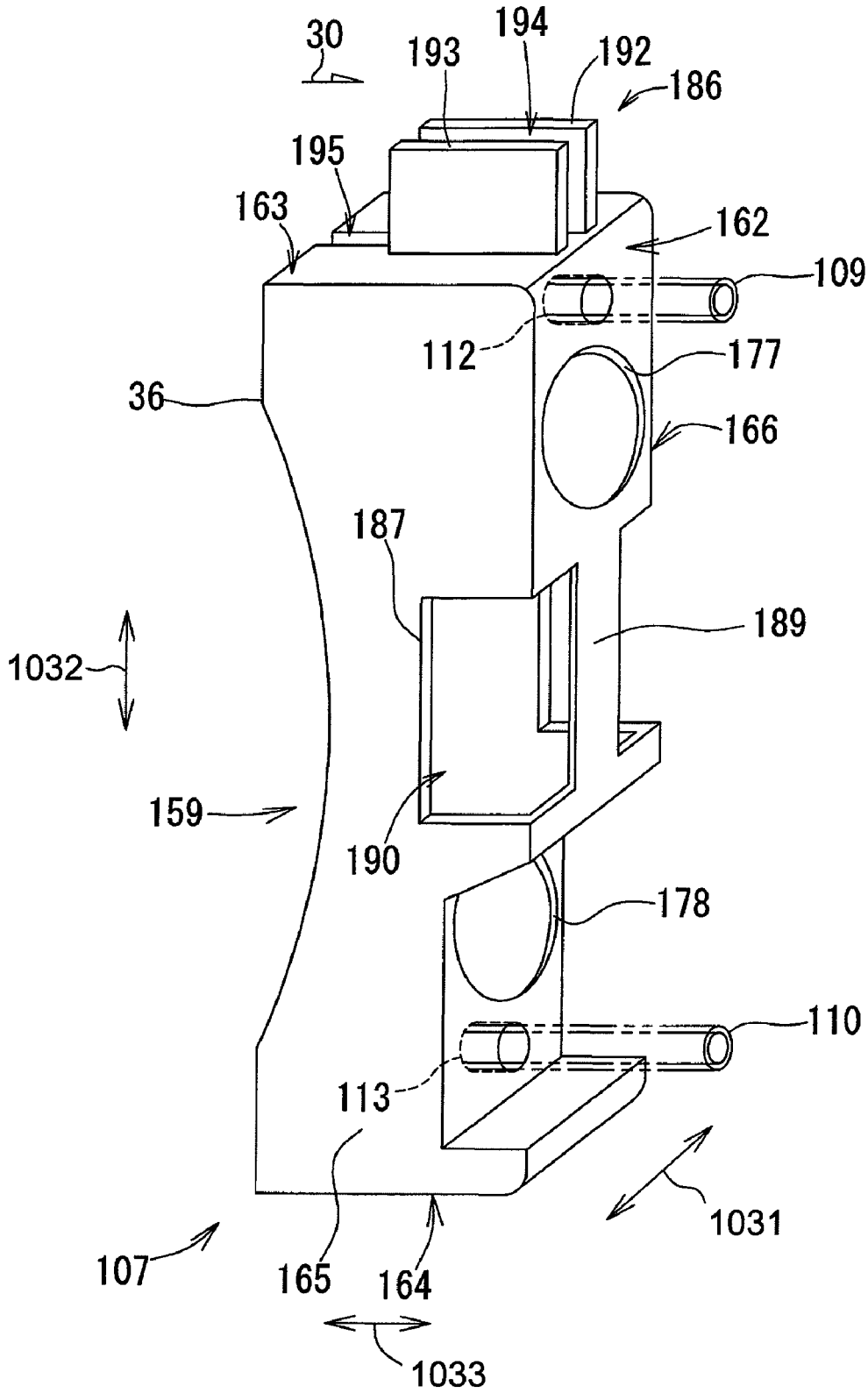
FIG. 14 is a perspective view of an adapter according to another embodiment of the invention.
Figure 15:
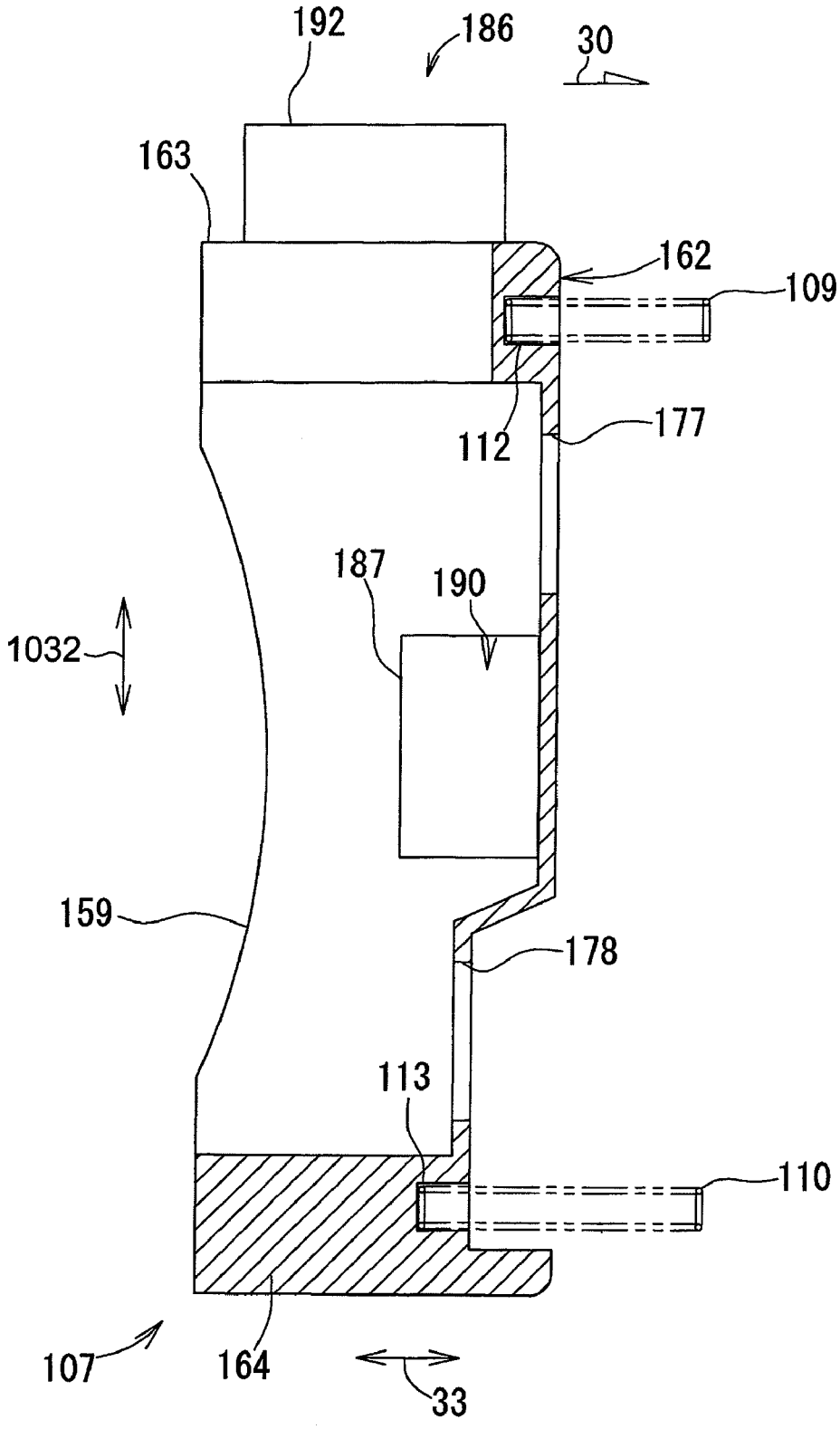
FIG. 15 is a side, cross-sectional view of the adapter of FIG. 14.

Referring to FIGS. 14 and 15, an adapter 107 according to another embodiment of the invention is depicted. The difference between adapter 27 and adapter 107 is that adapter 107 comprises coil springs 109, 110, and adapter 107 does not comprise operation portion 169. Coil springs 109, 110 are positioned at an outer surface of front wall 162 and extends from front wall 162 away from front wall 162 in depth direction 1033. Front wall 162 has a spring receiving chamber 112 formed therein at a position between top wall 163 and opening 177. Spring receiving chamber 112 is a cylindrical chamber extending from the outer surface of front wall 162 into front wall 162. Similarly, front wall 162 has a spring receiving chamber 113 formed therein at a position between bottom wall 164 and opening 178. Spring receiving chamber 113 is a cylindrical chamber extending from the outer surface of front wall 162 into front wall 162. An end of coil spring 109 is supported at the bottom of spring receiving chamber 112, and an end of coil spring 110 is supported at the bottom of spring receiving chamber 113. Coil springs 105, 106 may be replaced with leaf springs or rubber springs.

Figure 16:
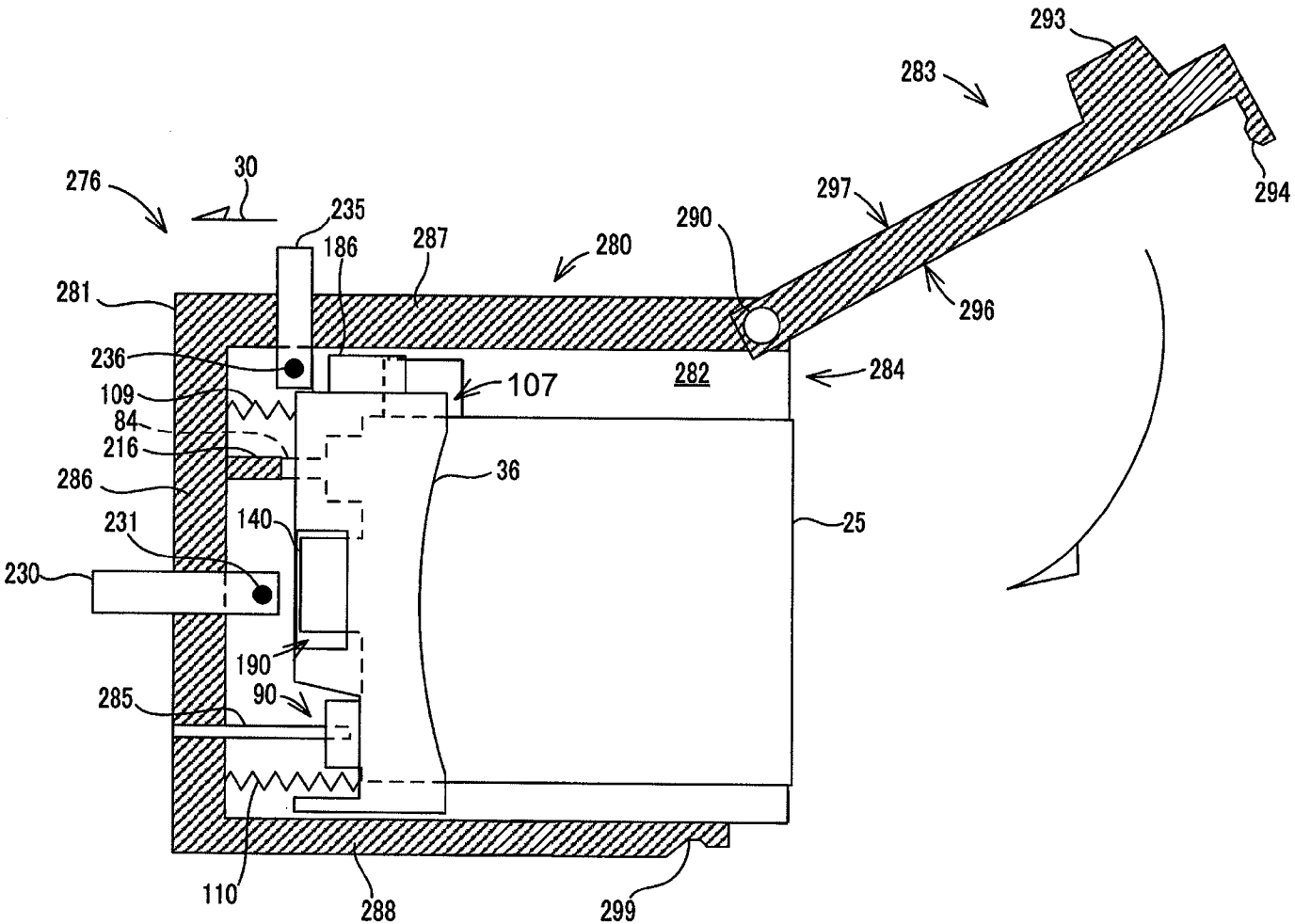
FIG. 16 is a side, partially cross-sectional, view of the cartridge mounting portion of FIG. 5, the adapter of FIG. 14, and the ink cartridge of FIGS. 2(A) and 2(B), in which the adapter and the ink cartridge are positioned in the cartridge mounting portion.
Figure 17:
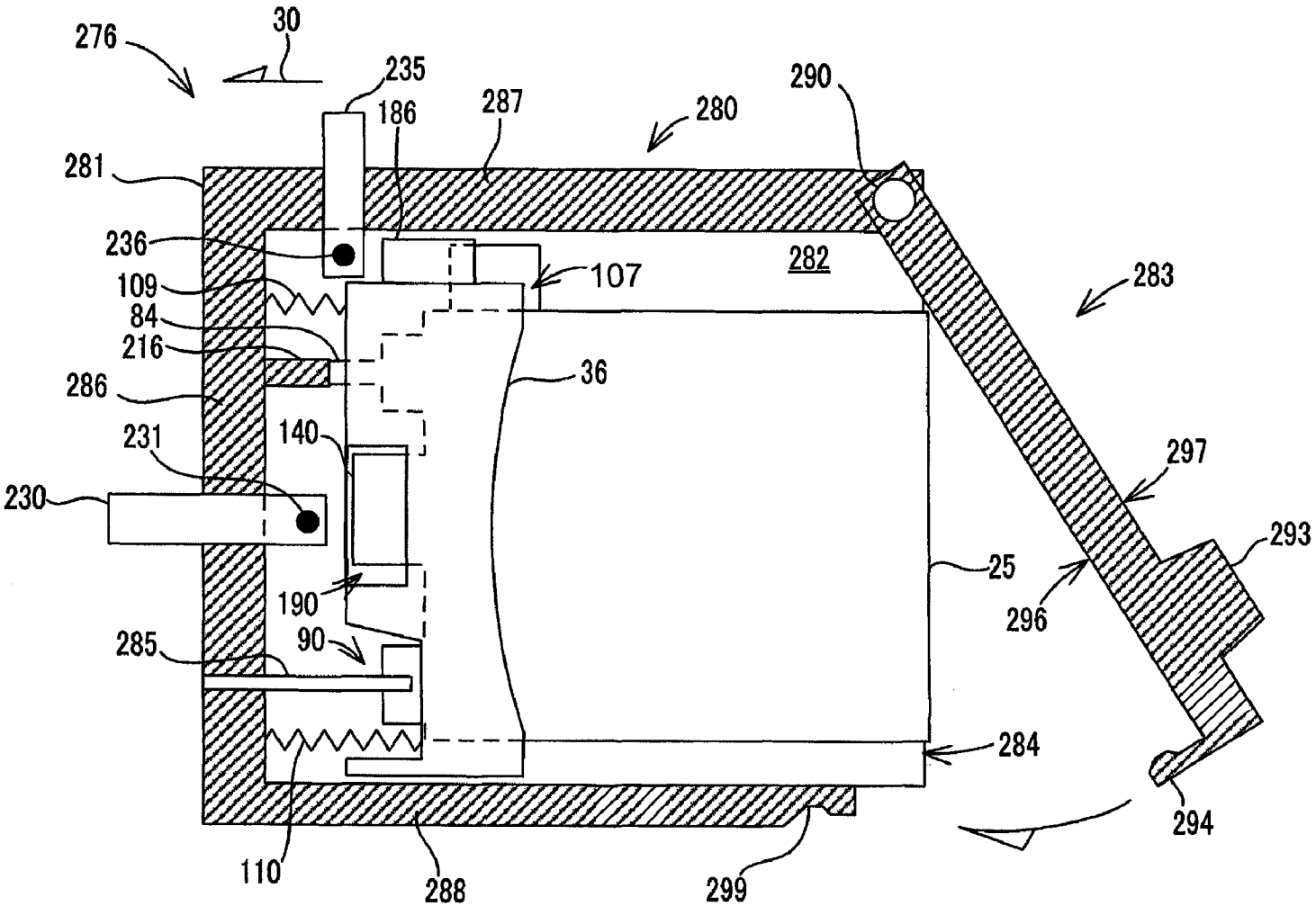
FIG. 17 is a side, partially cross-sectional, view of the cartridge mounting portion of FIG. 5, the adapter of FIG. 14, and the ink cartridge of FIGS. 2(A) and 2(B), in which the adapter and the ink cartridge are positioned in the cartridge mounting portion and the lock lever of the cartridge mounting portion contacts the ink cartridge.
Figure 18:
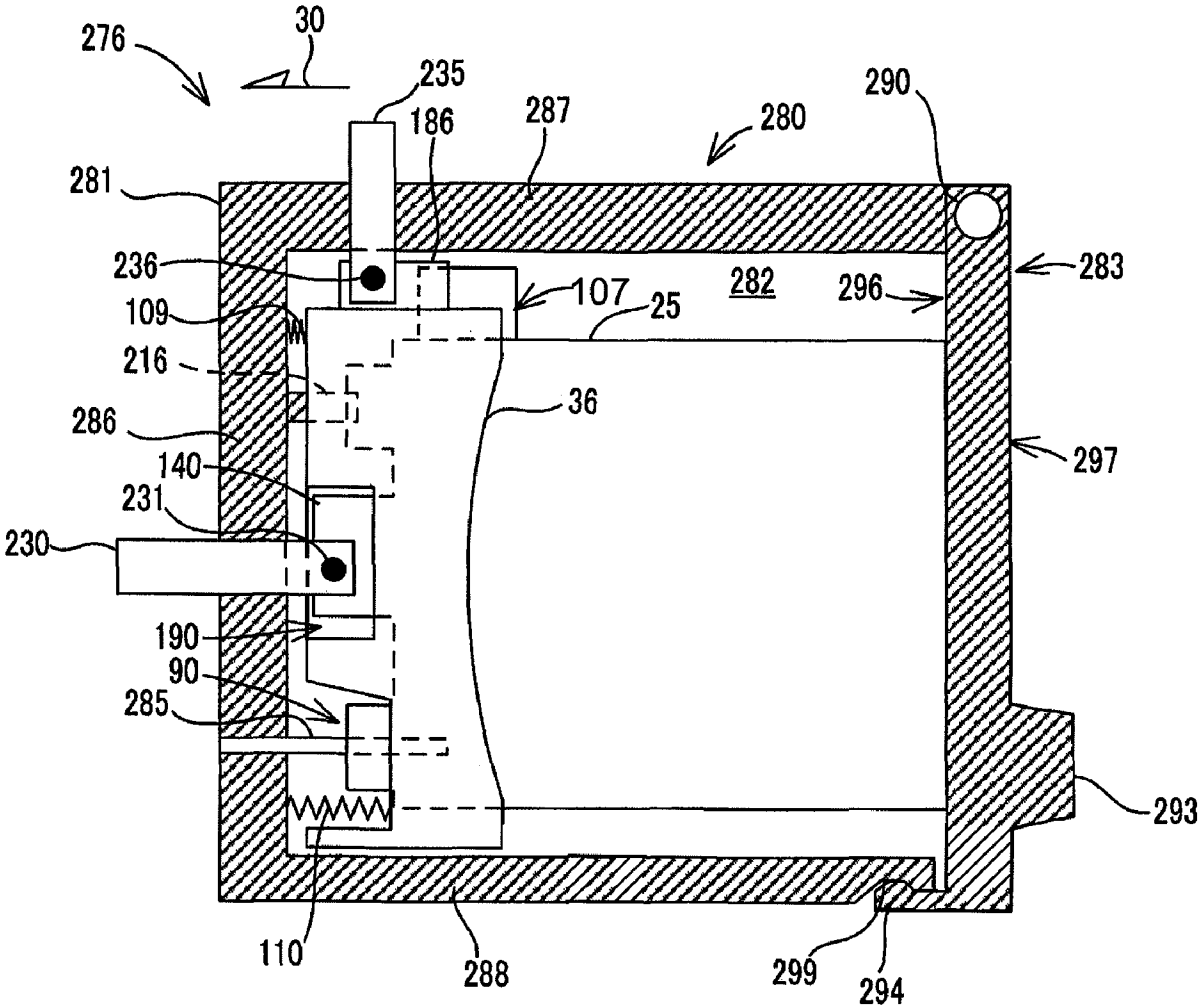
FIG. 18 is a side, partially cross-sectional, view of the cartridge mounting portion of FIG. 5, the adapter of FIG. 14, and the ink cartridge of FIGS. 2(A) and 2(B), in which the adapter and the ink cartridge are positioned in the cartridge mounting portion, the lock lever of the cartridge mounting portion contacts the ink cartridge, and the lock lever of the cartridge mounting portion is secured to the case of the cartridge mounting portion.

Referring to FIGS. 16-18, adapter 107 and ink cartridge 25 are inserted into accommodating chamber 282 and mounted to case 280 in the following manner.

When adapter 107 is inserted into accommodating chamber 282 from front wall 162-side via opening 284 toward end wall 286, front wall 162 faces end wall 286, and coil springs 109, 110 are positioned between front wall 162 and end wall 286 with ends of coils springs 109, 110 contacting end wall 286.

Subsequently, ink cartridge 25 is inserted into accommodating chamber 282 as shown in FIG. 16. Subsequently, lock lever 283 pivots toward opening 284, and inner surface 296 of lock lever 283 contacts rear outer face 42 of ink cartridge 25 as shown in FIG. 17. A user may push operation portion 293 to cause lock lever 283 to pivot. When lock lever 283 further pivots, lock lever 283 pushes ink cartridge 25 against biasing forces of coil springs 109, 110, respectively, while coil springs 109, 110 contract, respectively.

During the insertion of ink cartridge 25, bridge portion 189 enters optical path 231 of optical sensor 230, and detection portion 186 enters optical path 236 of optical sensor 235. Pushing portion 216 applies a force to rod 84, e.g., contacts and pushes rod 84 toward ink chamber 100 to cause the valve mechanism of air communication portion 80 to be opened. Ink chamber 100 is brought into fluid communication with the atmosphere via opening 81. Ink pipe 285 then enters ink supply portion 90, such that the valve mechanism of ink supply portion 90 is opened by ink pipe 285. Ink chamber 100 is brought into fluid communication with ink pipe 285, and ink is allowed to be supplied from ink chamber 100 to recording head 272 via opening 91, ink pipe 285, and tube 278. When ink tank 25 is inserted to the end, detection portion 140 is exposed to the exterior of adapter 27 via openings 190, and detection portion 140 is positioned in optical path 231 of optical sensor 230.

When the second end of lock lever 283 moves toward groove 299 and claw 294 engages groove 299, lock lever 283 is closed and secured to main body 281 as shown in FIG. 18. After lock lever 283 is closed, ink cartridge 25 receives the biasing forces of coil springs 109, 110 toward opening 284 such that rear outer face 42 contact inner surface 296 of lock lever 283, and therefore ink cartridge 25 is securely retained in case 280.

When ink cartridge 25 is removed from case 280, claw 294 disengages from groove 299, and lock lever 283 pivots upward. When this occurs, coil springs 109, 110 expand, respectively, and adapter 107 and ink cartridge 25 are pushed toward opening 284 by the biasing forces of coil springs 109, 110, and ink cartridge 25 is partially positioned outside case 280. Therefore, a user can readily remove adapter 107 and ink cartridge 25.

In the embodiments described above, adapter 27 or 107 is first inserted into accommodating chamber 282, and then ink cartridge 25 is inserted into accommodating chamber 282. Nevertheless, adapter 27 or 107 and ink cartridge 25 may be inserted into accommodating chamber 282 at the same time.

In another embodiment, detection portion 186 of adapter 27 or 107 may have a plurality of slits formed therein, and the plurality of slits may extend in height direction 1032. The number of the plurality of slits may depend on the characteristic of ink cartridge 25. The plurality of slits may allow light to pass therethrough. The controller may determine what kind of ink cartridge 25 is to be mounted by counting the number of the plurality of slits of detection portion 186 of adapter 27 or 107.

While the invention has been described in connection with exemplary embodiments, it will be understood by those skilled in the art that other variations and modifications of the exemplary embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being indicated by the flowing claims.

The invention claimed is:

1. An ink cartridge assembly comprising:

an ink cartridge defining an ink chamber therein, wherein the ink chamber is configured to store ink therein;

an adapter configured to be removably coupled to the ink cartridge and to couple the ink cartridge to a cartridge mounting portion of a recording apparatus, wherein the adapter and the ink cartridge are separate members, and the adapter comprises a main body having a main body opening formed therein, wherein the main body opening is configured to receive at least a portion of the ink cartridge therein; and at least one resilient member that is configured to bias the adapter and the ink cartridge from a position enclosed in the cartridge mounting portion to a position at which at least a portion of the adapter is exposed outside of the cartridge mounting portion, wherein when the adapter is coupled to the ink cartridge, the ink cartridge extends from a first face of the main body in a first direction, and the at least one resilient member extends from a second face of the main body in a second direction opposite the first direction.

2. The ink cartridge assembly of claim 1, wherein the ink cartridge comprises an ink supply portion configured to dispense ink from an interior of the ink chamber to an exterior of the ink chamber, and the adapter has an ink supply opening formed therethrough, wherein when the adapter is coupled to the ink cartridge, the ink supply opening is configured to receive the ink supply portion therethrough.

3. The ink cartridge assembly of claim 2, wherein the ink cartridge comprises an air intake portion configured to draw air from the exterior of the ink chamber to the interior of the ink chamber, and the adapter has an air intake opening formed therethrough, wherein when the adapter is coupled to the ink cartridge, the air intake opening is aligned with the air intake portion in the first direction.

4. The ink cartridge assembly of claim 1, wherein the adapter comprises a plate shaped portion, and a dimension of the plate shape portion in a direction parallel to the first and second directions is associated with a characteristic of the ink cartridge.

5. The ink cartridge assembly of claim 1, wherein the characteristic of the ink cartridge comprises at least one of an amount of ink that the ink chamber is configured to store and a color of ink stored in the ink chamber.

* * * * *